US006079161A

United States Patent [19]

Tomioka et al.

[11] Patent Number: 6,079,161

[45] Date of Patent: Jun. 27, 2000

[54] INDOOR TYPE SKIING GROUND, AND METHOD AND CONTROLLER FOR INDOOR TYPE SKIING GROUND

[75] Inventors: Masahiro Tomioka; Makoto Yotsuya; Masanori Shimazaki, all of Kobe; Jyunji Ogata, Takasago; Takayuki Irie, Takasago; Shuji Kakutani, Takasago; Masanori Ohsone, Kobe, all of Japan

[73] Assignee: Mitsubishi Heavy Industries, Ltd., Tokyo, Japan

[21] Appl. No.: 09/075,932

[22] Filed: May 12, 1998

[30] Foreign Application Priority Data

| | | | |
|---|---|---|---|
| May 16, 1997 | [JP] | Japan | 9-126785 |
| Jun. 16, 1997 | [JP] | Japan | 9-158258 |
| Sep. 5, 1997 | [JP] | Japan | 9-240730 |
| Sep. 11, 1997 | [JP] | Japan | 9-246317 |
| Sep. 11, 1997 | [JP] | Japan | 9-246319 |
| Dec. 15, 1997 | [JP] | Japan | 9-344792 |
| Jan. 19, 1998 | [JP] | Japan | 10-007299 |
| Jan. 19, 1998 | [JP] | Japan | 10-007300 |

[51] Int. Cl.[7] ..... F25C 3/04; E01C 13/12; A63C 19/10

[52] U.S. Cl. ..... 52/1; 52/173.1; 52/302.1; 62/74; 239/2.2; 472/90

[58] Field of Search ..... 52/1, 173.1, 175, 52/302.1; 62/74, 235, 347, 348; 239/2.2, 208; 472/90, 94

[56] References Cited

U.S. PATENT DOCUMENTS

| | | | |
|---|---|---|---|
| 2,136,758 | 11/1938 | Rosberg | 62/74 X |
| 3,250,530 | 5/1966 | Dean et al. | 472/90 |
| 3,257,815 | 6/1966 | Brocoff et al. | 62/347 X |
| 3,815,901 | 6/1974 | Wiig | 472/90 |
| 3,983,713 | 10/1976 | MacCracken | 472/90 X |
| 4,551,985 | 11/1985 | Kovach | 62/235 |
| 4,742,958 | 5/1988 | Bucceri | 239/2.2 |
| 5,102,044 | 4/1992 | Inoue et al. | 239/2.2 |
| 5,184,980 | 2/1993 | Ferris | 472/90 X |
| 5,230,218 | 7/1993 | Clulow | 62/74 |
| 5,241,830 | 9/1993 | Morioka et al. | 472/90 X |
| 5,272,883 | 12/1993 | Matsui et al. . | |
| 5,381,668 | 1/1995 | Morioka et al. . | |

FOREIGN PATENT DOCUMENTS

| | | | |
|---|---|---|---|
| A1-179880 | 7/1989 | Japan . | |
| 6-269533 | 9/1994 | Japan | 472/90 |
| B2-2531995 | 6/1996 | Japan . | |
| 2221024 | 1/1990 | United Kingdom . | |
| 2-248921 | 4/1992 | United Kingdom . | |
| 89-12793 | 12/1989 | WIPO . | |

*Primary Examiner*—Laura A. Callo

[57] ABSTRACT

In an indoor type skiing ground having a ski slope formed by sprinkling artificial snow to a predetermined thickness on a slope inside a building, a predetermined height range from the surface of the artificial snow is defined as a low temperature region, while an ordinary temperature region is defined above the low temperature region, and cold air ports for blowing cold air into the building are formed in a side wall of the building so as to be located in the low temperature region, while air outlets are formed so as to be located above the cold air ports.

19 Claims, 27 Drawing Sheets

INDOOR TYPE SKIING GROUND, AND METHOD AND CONTROLLER FOR INDOOR TYPE SKIING GROUND

BACKGROUND OF THE INVENTION

This invention relates to an indoor type skiing ground having a ski slope inside a building, a method for controlling the indoor type skiing ground, and a controller for the indoor type skiing ground.

With the progress and diversification of the leisure industry, a demand is growing that skiing be enjoyable in a comfortable environment without influences from natural conditions. To satisfy this demand, indoor type skiing grounds are constructed. This type of skiing ground is created in urban areas and their suburbs, but is also provided in outdoor skiing grounds so that skiing can be enjoyed even in bad weather.

FIG. 27 is a schematic side view showing the inside of a building of a conventional indoor type skiing ground. FIG. 28 is a schematic front view showing the inside of the building of the conventional indoor type skiing ground.

In a conventional indoor type skiing ground, as shown in FIGS. 27 and 28, a slope 002 is formed inside a building 001, and artificial snow 003 is deposited to a predetermined thickness on the slope 002 to form a ski slope 004. Near the ceiling of the building 001, an air compression pipe 005 is mounted, and an air compressor 006 provided outside the building 001 is connected to the air compression pipe 005. Along the air compression pipe 005, a water feed pipe 007 is laid, and a water feeder 008 provided outside the building 001 is connected to the water feed pipe 007. Between the air compression pipe 005 and the water feed pipe 007 arranged in parallel, a plurality of jet nozzles 009 are mounted which are shared by the air compression pipe 005 and the water feed pipe 007. A side wall of the building 001 is pierced by one end portion of a cold air supply pipe 010 which blows cold air into the building 001, and one end portion of an air discharge pipe 011 which discharges air from inside the building 001. The one end portions are open to the interior of the building 001. The other end portions of the cold air supply pipe 010 and the air discharge pipe 011 are connected to an air cooler 012.

Thus, cold air of about −10 to −15° C. is fed from the air cooler 012, and blown into the building 001 through the cold air supply pipe 010. Simultaneously, compressed air is supplied by the air compressor 006 to the air compression pipe 005, while water is supplied by the water feeder 008 to the water feed pipe 007. The compressed air and water are jetted through the jet nozzles 009. The resulting water jets are heat-exchanged with cooled air, and turned into artificial snow 003, which falls on the slope 002. When this procedure is continued for a certain period of time, snow piles up on the slope 002 to form a ski slope 004.

After the ski slope 004 having a certain-thickness layer of artificial snow 003 is formed on the slope 002, the supply of compressed air and water to the jet nozzles 009 is cut off to stop the formation and fall of artificial snow. Thus, skiers can enjoy skiing on the ski slope 004 blanketed with a satisfactory thickness of artificial snow in the state of snow not falling.

The cold air supply pipe 010 always blows cold air into the building 001. Even when artificial snow is not falling, this cooling air cools the entire interior of the building 001 to about −5 to −10° C., and thus can maintain the artificial snow 003 from compressed air and water in a good condition. To maintain artificial snow 003 of a high quality, the temperature of the surface of the artificial snow 003 needs to be held at a predetermined value (e.g., 2° C.) or less. To hold the snow surface temperature at 2° C. or lower, cold air of about −5 to −10° C. is continuously blown off, for example, to cool all the interior of the building 001.

With the conventional indoor type skiing ground, as described above, cold air of about −10 to −15° C. was fed into the building 001 by the air cooler 012. Simultaneously, compressed air and water were supplied from the air compressor 006 and water feeder 008, and jetted through the jet nozzles 009. Thus, the resulting water sprays were formed into artificial snow 003, which accumulated on the slope 002 to form the ski slope 004. To main the quality of the artificial snow 003 of the ski slope 004 at a high level, cold air was supplied throughout the inside of the building 001 so that the inside temperature was lowered to about −5 to −10° C.

To produce artificial snow 003 inside the building 001 and pile it up on the slope 002, all the interior of the building 001 has to be cooled. The air cooler 012 for supplying cold air into the building 001 is required to have a high capacity. Thus, this apparatus necessarily grows in size and its energy cost increases. It may be recommendable to bring the cold air supply pipe 010 to a lower height close to the snow surface, thereby cooling the snow surface principally. For a wide ski slope 004, however, cold air fails to reach its central area, which does not become cold at a suitable temperature. Besides, the areas near the outlet of the cold air supply pipe 110 are cooled considerably strongly. In these areas, snow that begins to melt becomes granulated, or a frozen ski slope is formed.

To maintain the ski slope 004 of a satisfactory quality, the operator's experience and sense were relied on to constantly supply cooling air to the inside of the building 001, thereby cooling it to about −5 to −10° C. However, the inside of the building 001 tended to be cooled excessively.

With the conventional indoor type skiing ground, as noted above, much labor was required, and the running cost became high, in order to maintain the snow quality of the ski slope 004 at a satisfactory level.

Furthermore, the entire interior of the building 001 was cooled with cold air from the cold air supply pipe 010 provided above. Hence, air at an upper position apart from the surface of the artificial snow 003 (e.g., the position of a skier's face) was at a subzero temperature, which made it difficult for skiers or workers to stay there for long periods of time. Skiers, in particular, did not feel entirely comfortable, and were unable to enjoy skiing in light dress.

To maintain the artificial snow 003 of the ski slope 004 in good condition, cooling air is supplied through the cold air supply pipe 010 to the entire interior of the building 001, which is thereby cooled to about −5 to −10° C. However, the artificial snow 003 of the ski slope 004 receives heat from lighting, radiant heat from the ceiling and side wall, or heat from glides of skis. Thus, the quality of snow in the ski slope 004 is gradually deteriorating.

When the quality of the artificial snow 003 of the ski slope 004 deteriorated, it was customary practice to scrape off and discharge the artificial snow 003 on the surface of the ski slope 004 at predetermined time intervals, sprinkle fresh artificial snow 003 over the entire area of the ski slope 004, and smooth it mechanically.

However, artificial snow 003 does not deteriorate in some places of the ski slope 004, so that there is no need to sprinkle fresh artificial snow 003 throughout the surface of the ski slope 004. Sprinkling fresh artificial snow 003 throughout the surface of the ski slope 004 requires that the entire area of the ski slope 004 be smoothed mechanically, thus making the operation extensive.

When the deteriorated artificial snow 003 of the ski slope 004 is to be scraped off and discharged, the ski slope 004 must be shut off to stop ski glides before the scraping operation is performed. Thus, the duration of use of the ski slope 004 is restricted. If the task of scraping off and discharging the artificial snow 003 of the ski slope 004 is to be carried out during the service hours of the ski slope 004, this task becomes tiresome. Furthermore, a dedicated machine is needed for scraping off a predetermined thickness of artificial snow 003 from the ski slope 004, and another dedicated machine becomes necessary for discharging the scraped snow.

When the set value of the inside temperature of the building 001 is increased, and the artificial snow 003 is renewed while being thawed, thawing occurs in the entire surface of the ski slope 004. The resulting meltwater cannot be drained appropriately, and an increased amount of dwelling water converts the artificial snow into sleet, thereby making ski glides impossible.

The present invention aims at solving the foregoing problems. A first object of the invention is to maintain a satisfactory quality of artificial snow and enable skiers to enjoy skiing in a relatively light dress, without performing excessive cooling.

A second object of the invention is to maintain the snow quality of a ski slope constantly at a satisfactory level, while reducing the energy cost, with the use of a simple and inexpensive structure.

A third object of the invention is to maintain the snow quality of a ski slope constantly at a satisfactory level, while decreasing the amount of snow thawed, with the use of a simple and inexpensive structure, and increase the accuracy of control for maintaining a good quality of snow to curtail energy consumption.

SUMMARY OF THE INVENTION

To attain the above-mentioned objects, a first aspect of the present invention is an indoor type skiing ground having a ski slope formed by sprinkling artificial snow to a predetermined thickness on a slope inside a building, wherein cold air ports, located near the surface height of the artificial snow, for blowing cold air into the building are formed in a side wall of the building.

A second aspect of the present invention is the indoor type skiing ground according to the first aspect of the invention, wherein air outlets located above the cold air ports are formed in the side wall of the building.

A third aspect of the present invention is the indoor type skiing ground according to the second aspect of the invention, wherein the interior of the building has a low temperature region ranging to a predetermined height from the surface of the artificial snow, and an ordinary temperature region above the low temperature region, and the cold air ports and the air outlets are formed in the low temperature region.

A fourth aspect of the present invention is the indoor type skiing ground according to the first aspect of the invention, wherein the cold air ports are each in the form of an elongated slit extending along the surface of the artificial snow.

A fifth aspect of the present invention is an indoor type skiing ground having a ski slope formed by sprinkling artificial snow to a predetermined thickness on a slope inside a building, the indoor type skiing ground comprising a snow former for producing artificial snow, a depository for temporarily storing artificial snow produced by the snow former, a snow carrier for carrying artificial snow stored in the depository, a plurality of snow sprinklers disposed in the ski slope so as to be capable of sprinkling artificial snow carried by the snow carrier onto the entire area of the ski slope surface, a ski slope snow accumulation controller for controlling the snow sprinklers in accordance with the amount of artificial snow accumulated on the ski slope to sprinkle artificial snow in a predetermined area of the ski slope surface, thereby forming an artificial snowfall of a predetermined thickness suitable for ski glides, and a ski slope cooler for supplying cold air to the vicinity of the surface height of artificial snow of the ski slope.

A sixth aspect of the present invention is the indoor type skiing ground according to the fifth aspect of the invention, wherein the snow carrier is snow carrying pipes for carrying the artificial snow stored in the depository to the ski slope by a rotary feeder, and a front end portion of each of a plurality of the snow carrying pipes disposed in the ski slope is fitted with a snow sprinkling nozzle as the snow sprinkler.

A seventh aspect of the present invention is the indoor type skiing ground according to the first aspect of the invention, wherein a material for and the thickness of a heat insulating member are set such that a lower surface portion of an artificial snowfall that constitutes the ski slope is thawed by a predetermined thickness under the action of heat transferred via the heat insulating member from below the artificial snowfall.

An eighth aspect of the present invention is the indoor type skiing ground according to the seventh aspect of the invention, wherein the ski slope is composed of the heat insulating member laid on the upper surface of a floor surface portion, a concrete floor laid on the upper surface of the heat insulating member, and an artificial lawn laid on the upper surface of the concrete floor.

A ninth aspect of the present invention is the indoor type skiing ground according to the eighth aspect of the invention, wherein a meltwater channel is formed in the upper surface of the concrete floor at least along the direction of inclination of the slope, and a plurality of through-holes through which meltwater formed by thawing of the artificial snowfall flows down into the meltwater channel are formed in the artificial lawn.

A tenth aspect of the present invention is the indoor type skiing ground according to the first aspect of the invention, wherein a partition member for partitioning an inside space of the building vertically into two spaces, a space on the side of the ceiling and a space on the side of the ski slope, is disposed inside the building.

An eleventh aspect of the present invention is the indoor type skiing ground according to the first aspect of the invention, wherein cold air ports for blowing cold air to the vicinity of the surface height of the artificial snow are formed in an upper part of the slope, while air outlets for discharging cold air lying near the surface height of the artificial snow are formed in a lower part of the slope.

A twelfth aspect of the present invention is the indoor type skiing ground according to the first aspect of the invention, wherein a plurality of blowoff ports open at the upper surface of the slope and at a lower portion of the accumulated snow are provided for jetting cold air at a high velocity through the artificial snow on the slope toward areas above the snow surface.

A thirteenth aspect of the present invention is the indoor type skiing ground according to the twelfth aspect of the invention, wherein the plurality of blowoff ports are located in a central portion of the ski slope.

A fourteenth aspect of the present invention is the indoor type skiing ground according to the first aspect of the invention, wherein an expansible expansion pipe is provided in a hole formed in the slope, and a cold air blowoff nozzle for blowing off cold air to the vicinity of the surface height of the artificial snow is provided at an upper end portion of the expansion pipe.

A fifteenth aspect of the present invention is the indoor type skiing ground according to the fourteenth aspect of the invention, wherein the cold air blowoff nozzle has at the top a cover for closing the hole.

A sixteenth aspect of the present invention is the indoor type skiing ground according to the fourteenth aspect of the invention, wherein the cold air blowoff nozzle has an accumulated snow drilling unit for forming in the artificial snow a communication hole which communicates with the upper portion of the hole.

A seventeenth aspect of the present invention is a method for controlling an indoor type skiing ground, which comprises sprinkling artificial snow to a predetermined thickness on a slope inside a building to form a ski slope, and thawing a lower surface portion of an artificial snowfall constituting the ski slope, while sprinkling artificial snow on an upper surface portion of the artificial snowfall, to replenish artificial snow, thereby maintaining the thickness of the artificial snowfall of the ski slope at a constant value.

An eighteenth aspect of the present invention is the method for controlling an indoor type skiing ground according to the seventeenth aspect of the invention, wherein radiant heat from a ceiling and wall of the building, heat imposed during ski glides on the ski slope, heat input from lighting inside the building, heat penetrating from below a floor of the slope, snow surface cooling heat from cold air supplied to a space above a snow accumulated portion, and latent heat of evaporation from the snow accumulated portion are used as control factors; and the temperature of the cold air supplied to the space above the snow accumulated portion for controlling the snow surface cooling heat is adjusted so that the snow surface cooling heat and the latent heat of evaporation are balanced against the radiant heat from the ceiling and wall, the heat imposed during ski glides, the heat input from lighting, and the heat penetrating from below the floor of the slope, whereby a heat balance is held at a constant value.

A nineteenth aspect of the present invention is the method for controlling an indoor type skiing ground according to the eighteenth aspect of the invention, wherein the radiant heat from the ceiling and wall is determined from a temperature-heat quantity change model which is selected according to the temperature of an inner surface of the ceiling and the temperature of an inner surface of the wall in the building and which is in a certain relationship therewith, the heat imposed during ski glides is determined from the number of visitors to the ski slope and activity intensity which serves as an indicator of heat generation during a ski glide, the heat input from the lighting is determined from the power consumption of the lighting, the heat penetrating from below the floor of the slope is determined as an overall heat transfer coefficient from measurements of the temperatures at the upper and lower surfaces of the snow accumulated portion, and the latent heat of evaporation is determined from the amount of condensate in a returned air stream of cold air supplied to the space above the snow accumulated portion.

A twentieth aspect of the present invention is a controller for an indoor type skiing ground, the indoor type skiing ground having a ski slope formed by sprinkling artificial snow to a predetermined thickness on a slope inside a building, and the indoor type skiing ground being adapted to thaw a lower surface portion of a snow accumulated region of the ski slope, while sprinkling artificial snow on an upper surface portion of the snow accumulated region, to replenish artificial snow, and supply cold air from an air cooler to a space above the snow accumulated region, thereby maintaining the thickness of the snow accumulation region at a constant value; the controller comprising a snow surface cooling air stream control device which uses as control factors radiant heat from a ceiling and wall of the building, heat imposed during ski glides on the ski slope, heat input from lighting inside the building, heat penetrating from below a floor of the slope, snow surface cooling heat due to cold air from the air cooler, and latent heat of evaporation from the snow accumulated region and which adjusts the temperature of the cold air blown off from the air cooler to control the snow surface cooling heat so that the snow surface cooling heat and the latent heat of evaporation are balanced against the radiant heat from the ceiling and wall, the heat imposed during ski glides, the heat input from the lighting, and the heat penetrating from below the floor of the slope.

DETAILED DESCRIPTION OF THE PREFERRED EMBODIMENTS

The preferred embodiments of the present invention will now be described in detail by reference to the accompanying drawings.

<First Embodiment>

Figure 1:
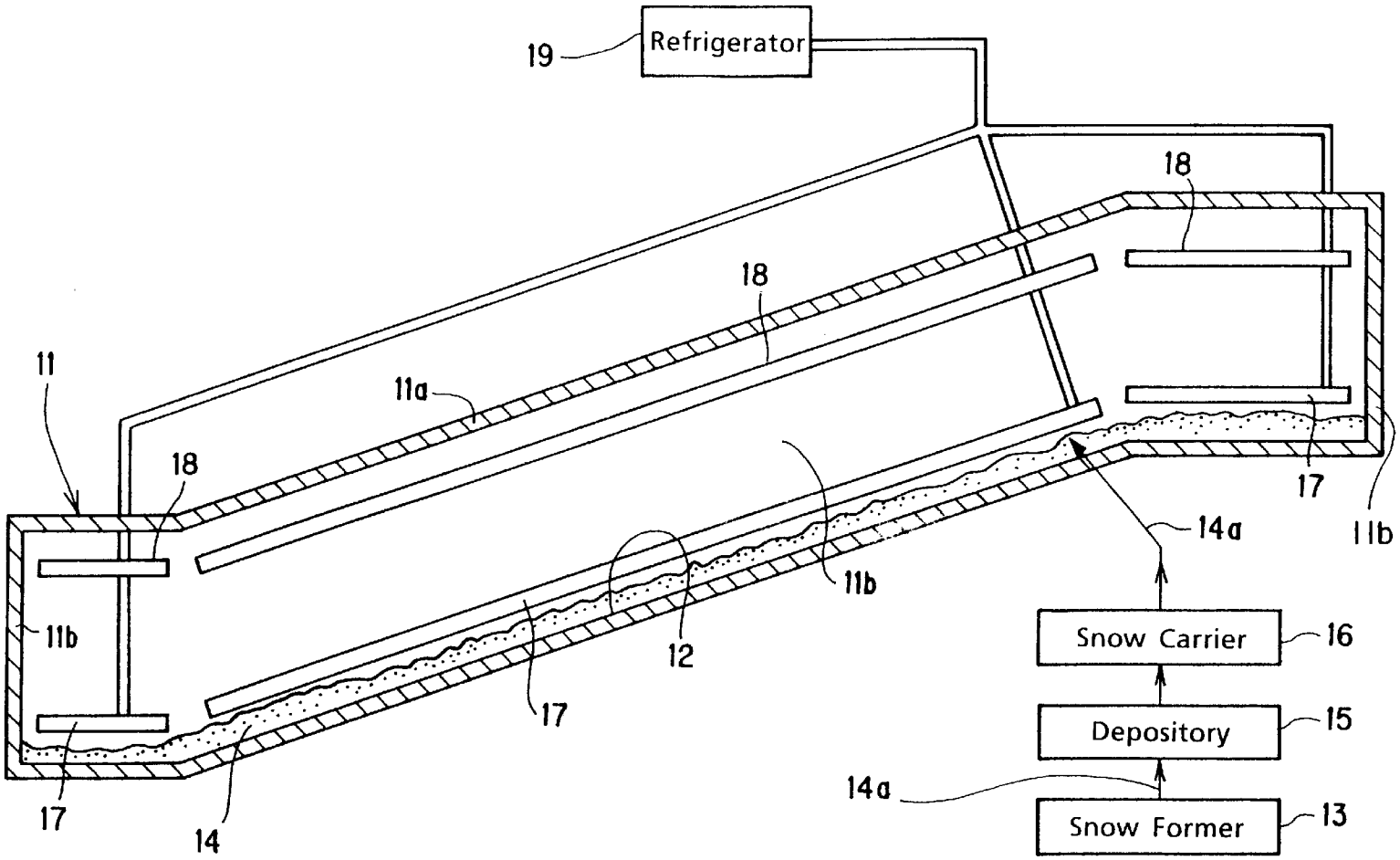
FIG. 1 is a schematic side view of the interior of a building showing a cooler of an indoor type skiing ground related to a first embodiment of the present invention.
Figure 2:
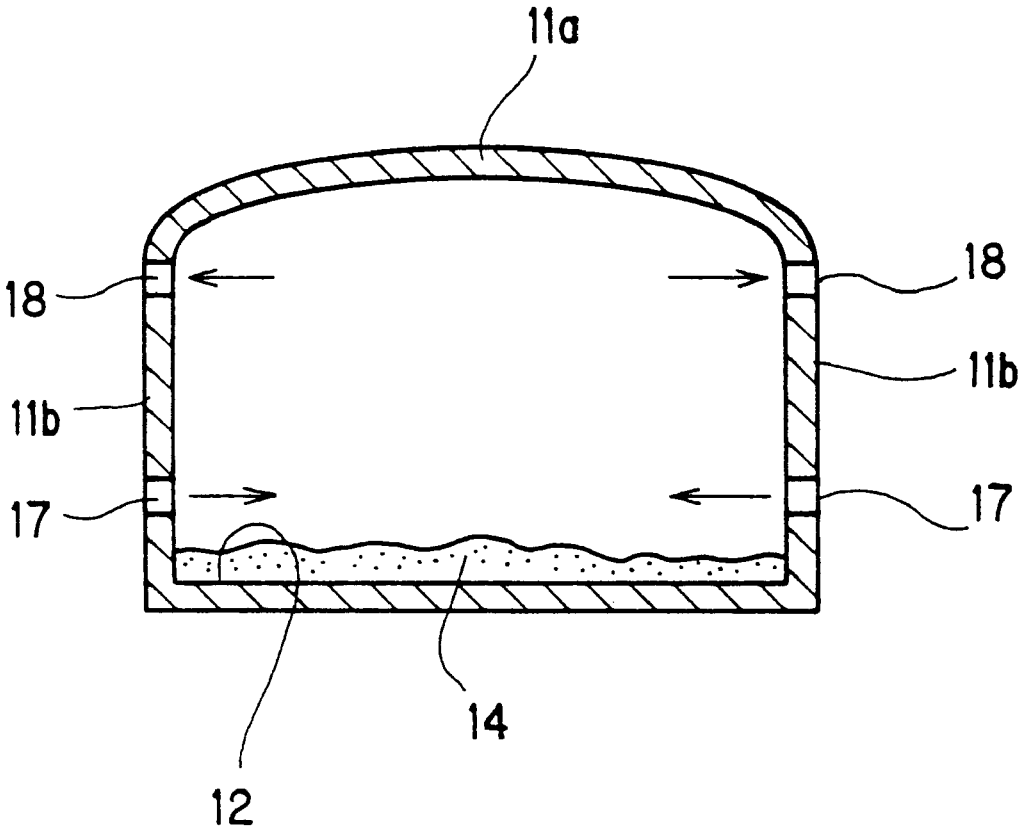
FIG. 2 is a schematic front view of the interior of the building of the indoor type skiing ground according to this embodiment.

In an indoor type skiing ground according to this embodiment, as shown in FIGS. 1 and 2, a lower surface of the interior of a building 11 constitutes a slope, and the slope is sprinkled with artificial snow to a predetermined thickness to form a ski slope 12.

In this indoor type skiing ground, artificial snow 14*a* is produced by a snow former 13, and the resulting artificial snow 14*a* is stored in a depository 15. The artificial snow 14*a* stored in the depository 15 is carried (pneumatically or in other manner) to the ski slope 12 by a snow carrier 16 to form an artificial snowfall 14 on the ski slope 12. Once the artificial snowfall 14 reaches a predetermined thickness suitable for skiing, the carriage and supply of artificial snow 14*a* to the ski slope 12 are stopped.

In a side wall 11*b* of the building 11, many cold air ports 17 are formed for blowing cold air into the building 11, and many air outlets 18 are formed for discharging air from inside the building 11. The cold air ports 17 are arranged such that their height is positioned near the surface height of the artificial snowfall 14 with a predetermined thickness (a thickness suitable for skiing) The air outlets 18 are arranged such that their height is positioned above the height position of the cold air ports 17. The cold air ports 17 and the air outlets 18 are each in the form of an elongated slit extending along the surface of the artificial snowfall 14.

A refrigerator 19 supplies cold air, cooled at a necessary temperature enough to be able to maintain the snow quality of the artificial snowfall 14 at a satisfactory level (a temperature not reaching −5° C. or lower, say, a temperature of −5 to 0° C. on the snow surface depending on the number of visitors), to the plurality of cold air ports 17. This cold air is fed toward the snow surface of the artificial snowfall 14 through the cold air ports 17. Thus, the surface of the artificial snowfall 14 is cooled with cold air supplied through the cold air ports 17, and becomes free from thawing. The cold air keeps the snow quality of the artificial snowfall 14 satisfactory, and decreases the amount of air required.

The cold air fed toward the surface of the artificial snowfall 14 cools the surroundings (artificial snowfall 14, etc.), heat-exchanges with them, and rises in temperature. This warmed air moves upward (as an ascending stream) away from the surface of the artificial snowfall 14, and is then discharged to the outside of the building 11 through the air outlets 18. Thus, only a space below the air outlets 18 is cooled with cold air, with the result that the temperature of air inside the building 11 is cold below and warm above. A so-called temperature-stratified condition is created to carry out satisfactory cooling.

With the indoor type skiing ground of the present embodiment, therefore, it becomes possible to effectively perform cooling enough to maintain the quality of the artificial snowfall 14 at a satisfactory level, without cooling the entire interior of the building 11 excessively. Besides, the temperature of the cold air supplied by the refrigerator 19 is 0° C. or lower, but does not reach −15° C. or lower. The object to be cooled with the cold air is not the whole of the building 11, but is restricted to the surface of the artificial snowfall 14. Thus, the amount of air required is small, so that the refrigerator 19 may be a model with a low refrigerating capacity. Accordingly, the running cost for the refrigerator 19 can be cut down, and the space for installation of the refrigerator 19 can be reduced.

In addition, cold air is fed through the cold air ports 17 toward the surface of the artificial snowfall 14. Thus, air at an upper position away from the snow surface of the artificial snowfall 14 (e.g., the site of a skier's face) is not extremely cold, ensuring a comfortable environment for skiers. Furthermore, the cold air ports 17 are in an elongated slit form extending along the surface of the artificial snowfall 14, so that cold air can be supplied uniformly along the surface of the artificial snowfall 14. Such slit-shaped cold air ports 17, compared with tubular cold air ports, decrease the amount of air entrained from areas perpendicular to the cold air port 17, thus improving the efficiency of cooling.

An improvement in the cooling efficiency by the formation of the air outlets 18 will be described supplementally. In the instant embodiment, as stated earlier, cold air supplied through the cold air ports 17 initially flows along the snow surface of the artificial snowfall 14. Then, the cold air exchanges heat with the surroundings, and increases in temperature, turning into an upward airflow and leaving the snow surface. The ascending cold air having left the snow surface is discharged to the outside of the building 11 through the air outlets 18.

In the instant embodiment, the heat input to the artificial snowfall 14 of the ski slope 12 includes not only the air temperature inside the building 11, but also the heat generated from the bodies of skiers, the heat produced by ski glides, the radiant heat from the ceiling 11*a*, and radiation from lighting. The temperature of cold air blown off through the cold air ports 17 is sufficient to cancel out these heat input conditions, thereby reliably cooling the surface of the artificial snowfall 14 to maintain snow of satisfactory quality.

<Second Embodiment>

Figure 3:
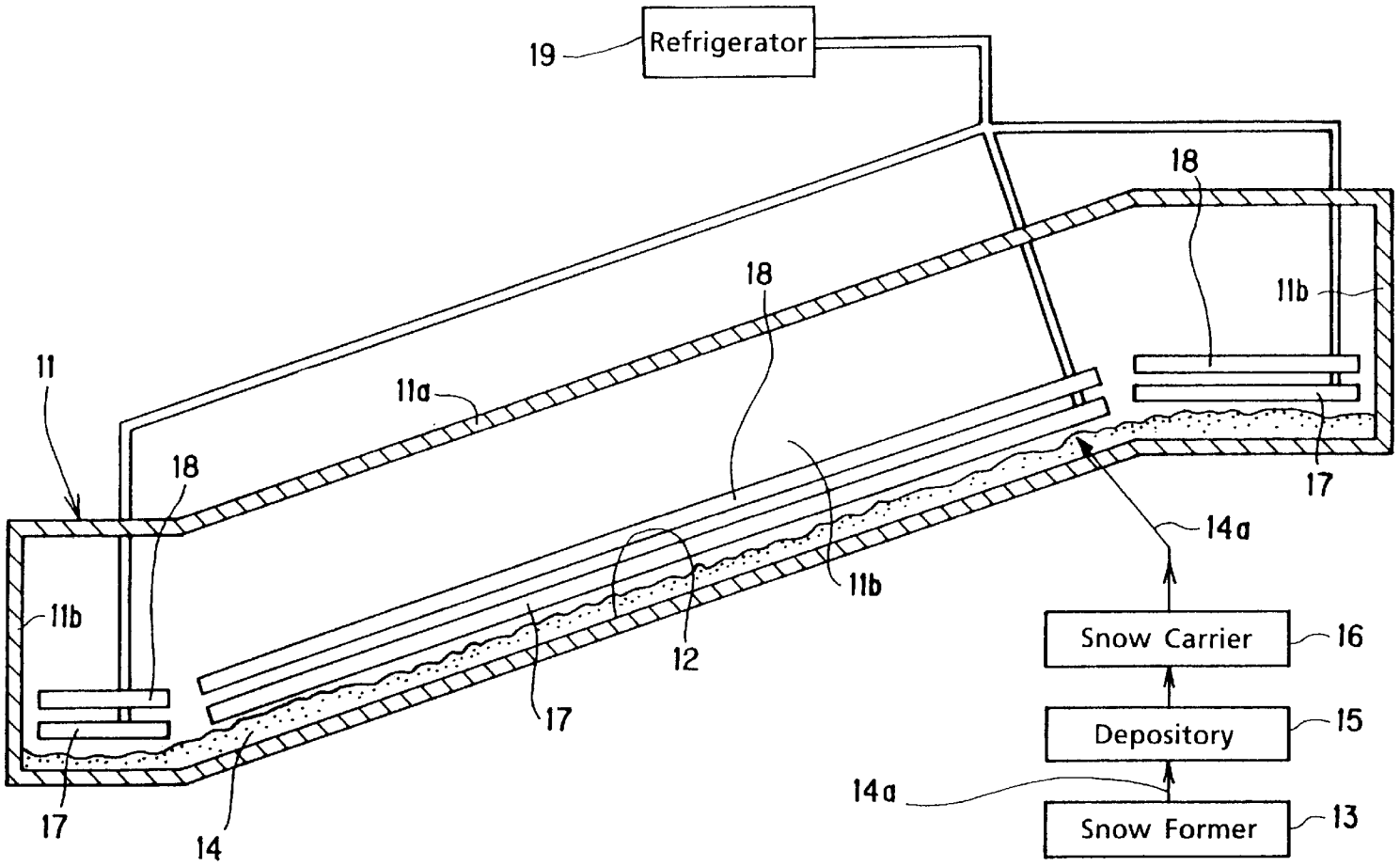
FIG. 3 is a schematic side view of the interior of a building showing a cooler of an indoor type skiing ground related to a second embodiment of the present invention.
Figure 4:
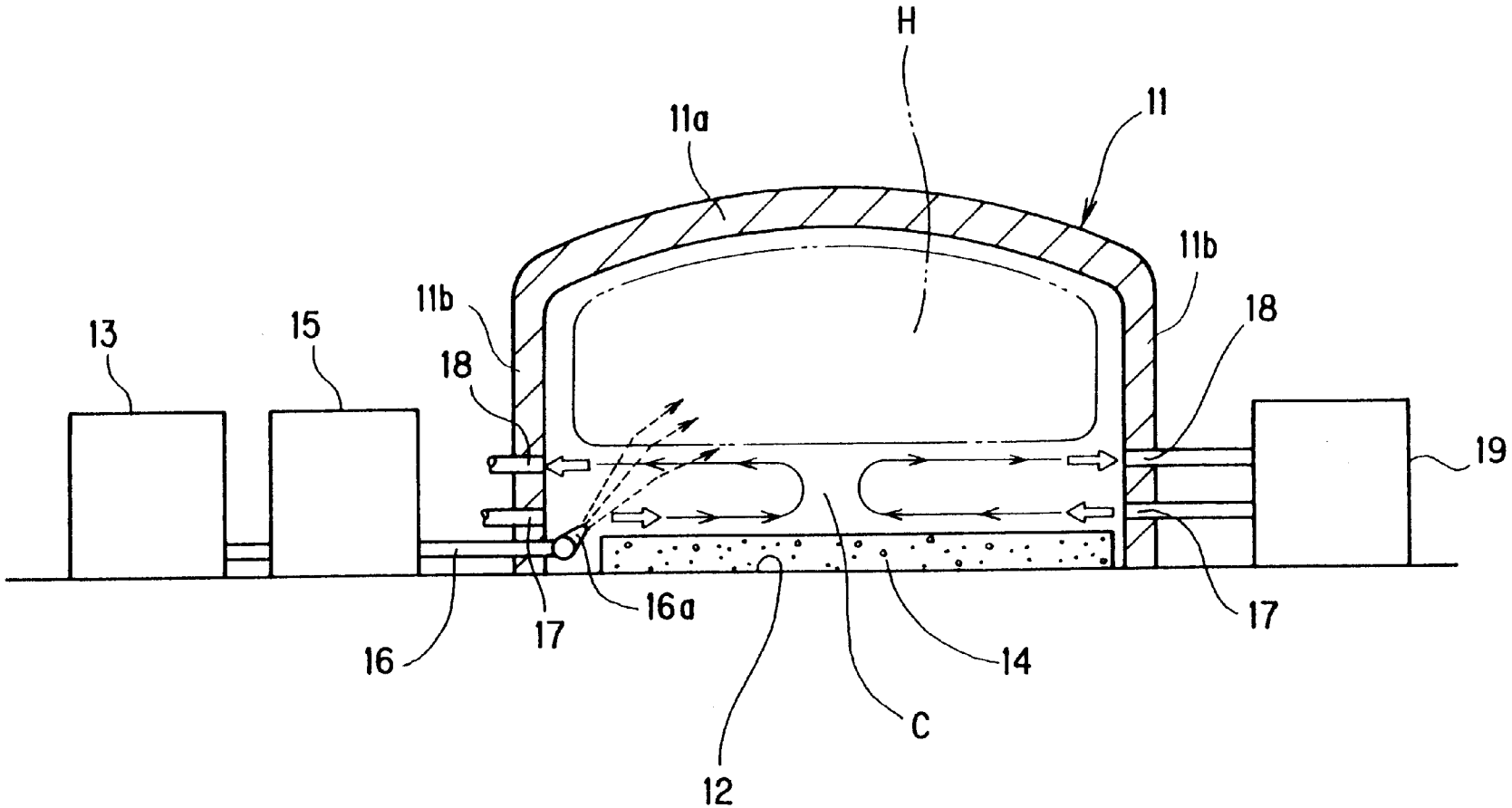
FIG. 4 is a schematic front view of the interior of the building of the indoor type skiing ground according to this embodiment.

An indoor type skiing ground according to this embodiment has a more restricted space for cooling with air. As shown in FIGS. 3 and 4, a ski slope 12 is formed inside a building 11. In this indoor type skiing ground, artificial snow 14*a* is produced by a snow former 13, and stored in a depository 15. The artificial snow 14*a* is then carried under pressure to the ski slope 12 by a snow carrier (snow carriage pipe) 16 to form an artificial snowfall 14 on the ski slope 12.

In a side wall 11*b* of the building 11, many cold air ports 17 for blowing cold air into the building 11, and many air outlets 18 for discharging air from inside the building 11 are arranged vertically in pairs. Each cold air port 17 has a height position close to the surface height of the artificial snowfall 14 with a predetermined thickness (a thickness suitable for skiing). Each air outlet 18 has a height position slightly above the height position of the cold air port 17. The cold air port 17 and the air outlet 18 are each in the form of an elongated slit extending along the surface of the artificial snowfall 14.

A refrigerator 19 connected to each cold air port 17 can supply cold air at a temperature enough to maintain the snow quality of the artificial snowfall 14 at a satisfactory level (e.g., a temperature of −5 to 0° C.) This cold air is fed toward the snow surface of the artificial snowfall 14 through the cold air ports 17. Thus, the surface of the artificial snow 14 is cooled with this cold air, so that the artificial snowfall 14 is free from thawing and its snow quality is kept satisfactory.

The cold air fed toward the surface of the artificial snowfall 14 cools the surroundings (artificial snowfall 14 and air), heat-exchanges with them, and rises in temperature. The warmed air is discharged to the outside of the building 11 through the air outlets 18 located directly above the cold air ports 17. Thus, only a space positioned below the air outlets 18 is cooled with cold air to define a low temperature region C, while a space located above the air outlets 18 constitutes an ordinary temperature region H, with the result that the air is cold below and warm above. A so-called temperature-stratified condition is created clearly to carry out satisfactory cooling.

With the indoor type skiing ground of the present embodiment, therefore, the entire interior of the building 11 is not cooled, but only the low temperature region C close to the surface of the artificial snowfall 14 is cooled. Thus, it becomes possible to effectively perform cooling enough to maintain the snow quality of the artificial snowfall 14 at a satisfactory level, while decreasing the required amount of air, and reducing the capacity of the refrigerator 19. Since only the low temperature region C is cooled, moreover, air in an upper space apart from the snow surface of the artificial snowfall 14 (e.g., a space near the ceiling) is on a high temperature side compared with the snow surface. Its temperature difference from the outside air becomes smaller than in earlier technologies, so that the quantity of heat passed can be decreased.

In each of the above-described embodiments, the air outlets 18 are either formed at a position close to the ceiling 11*a*, or formed in the low temperature region C directly above the cold air ports 17. However, their position of formation is not restricted to either case. Their vertical position may be adjusted so as to control the thickness of the cold air layer (low temperature region C: the vertical height of the cold air layer ranging from the snow surface of the artificial snowfall 14 to the height position of the air outlet 18). It is also permissible to concentrate the air outlets 18 at the upper end face of the ski slope 12 without providing them in the side wall portion, and to maintain the low temperature region C by the amount of cold air blown off through the cold air ports 17.

According to the indoor type skiing ground of the present invention, artificial snow is sprinkled over the slope inside the building to a predetermined thickness to form a ski slope, and the cold air ports, located near the surface height of the artificial snowfall, for blowing cold air into the building are formed in the side wall of the building. Thus, the surface of the artificial snowfall is cooled satisfactorily with cold air supplied through the cold air ports into the building. The object to be cooled with the cold air is restricted to the surface of the artificial snowfall. Besides, the temperature of the cold air is adjusted at a value enough to be able to maintain satisfactory quality of the artificial snowfall, and the amount of air required is decreased. Thus, the refrigerating capacity of the refrigerator or the like can be made low, and the cooling efficiency can be increased. In addition, the running costs for the refrigerator and the blowoff source for cooling air can be cut down, and the space for installation of the refrigerator can be reduced.

According to the indoor type skiing ground of the present invention, the air outlets are formed in the side wall of the building so as to be positioned above the cold air ports. Thus, cold air supplied through the cold air ports into the building exchanges heat with the artificial snowfall and air to cool the surface of the artificial snowfall. During this action, the cold air increases in temperature, and the warmed cold air turns into an ascending air stream, moving upward. Then, the warm air stream is discharged to the outside of the building through the air outlets. In this manner, only the surface of the artificial snowfall can be cooled efficiently, and the snow quality of the artificial snowfall can be kept satisfactory.

According to the indoor type skiing ground of the present invention, furthermore, the interior of the building is divided into the low temperature region in a predetermined height range from the surface of the artificial snowfall, and the ordinary temperature region located above the low temperature region, and the cold air ports and the air outlets are formed in the low temperature region. This makes it possible to achieve temperature stratification, a state in which of the space inside the building, only the space below the air outlets is cooled. This leads to an improvement in the cooling efficiency. In addition, the temperature at an upper position spaced from the snow surface is not extremely low, so that skiing can be played in a comfortable environment.

Also, according to the indoor type skiing ground of the present invention, the cold air ports are in an elongated slit form extending along the surface of the artificial snowfall. Thus, cold air can be supplied uniformly along the surface of the artificial snowfall, with a decrease achieved in the amount of air entrained from areas perpendicular to the cold air port, thereby improving the efficiency of cooling.

<Third Embodiment>

Figure 5:
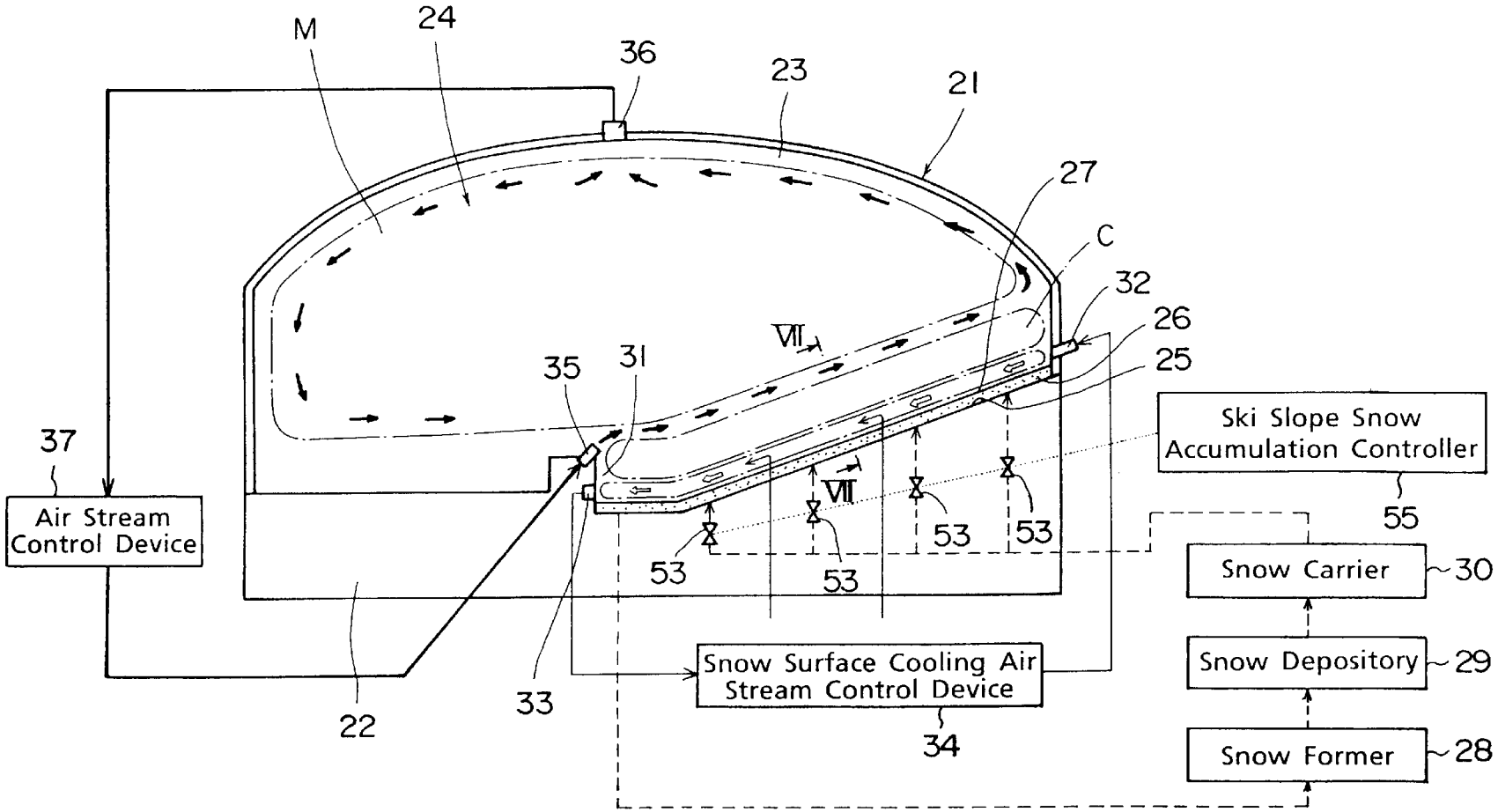
FIG. 5 is a schematic side view showing a system of an entire dome to which an indoor type skiing ground related to a third embodiment of the present invention has been applied.
Figure 6:
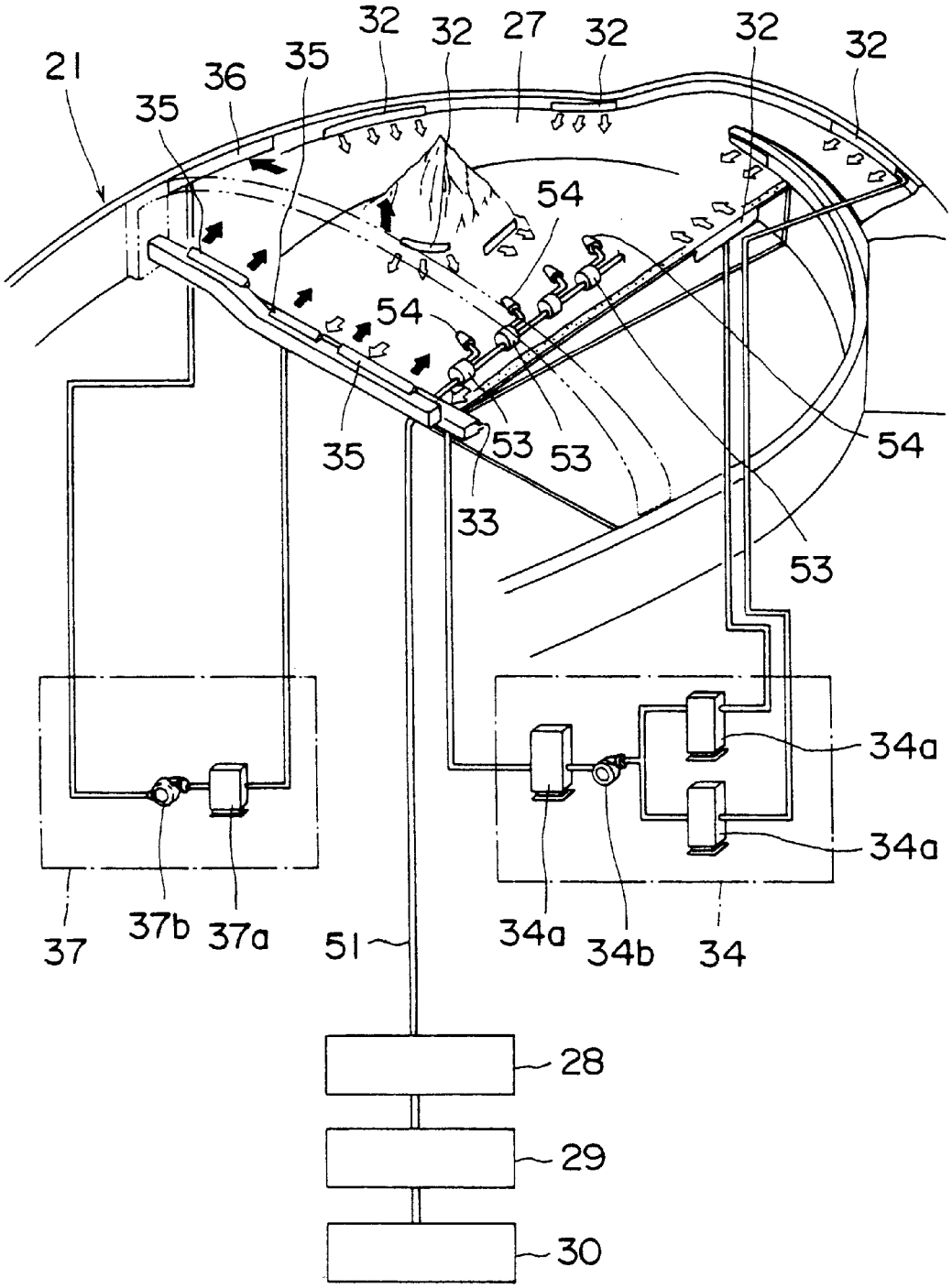
FIG. 6 is a schematic view showing air conditioning and snowfall controlling mechanisms of the indoor type skiing ground.
Figure 7:
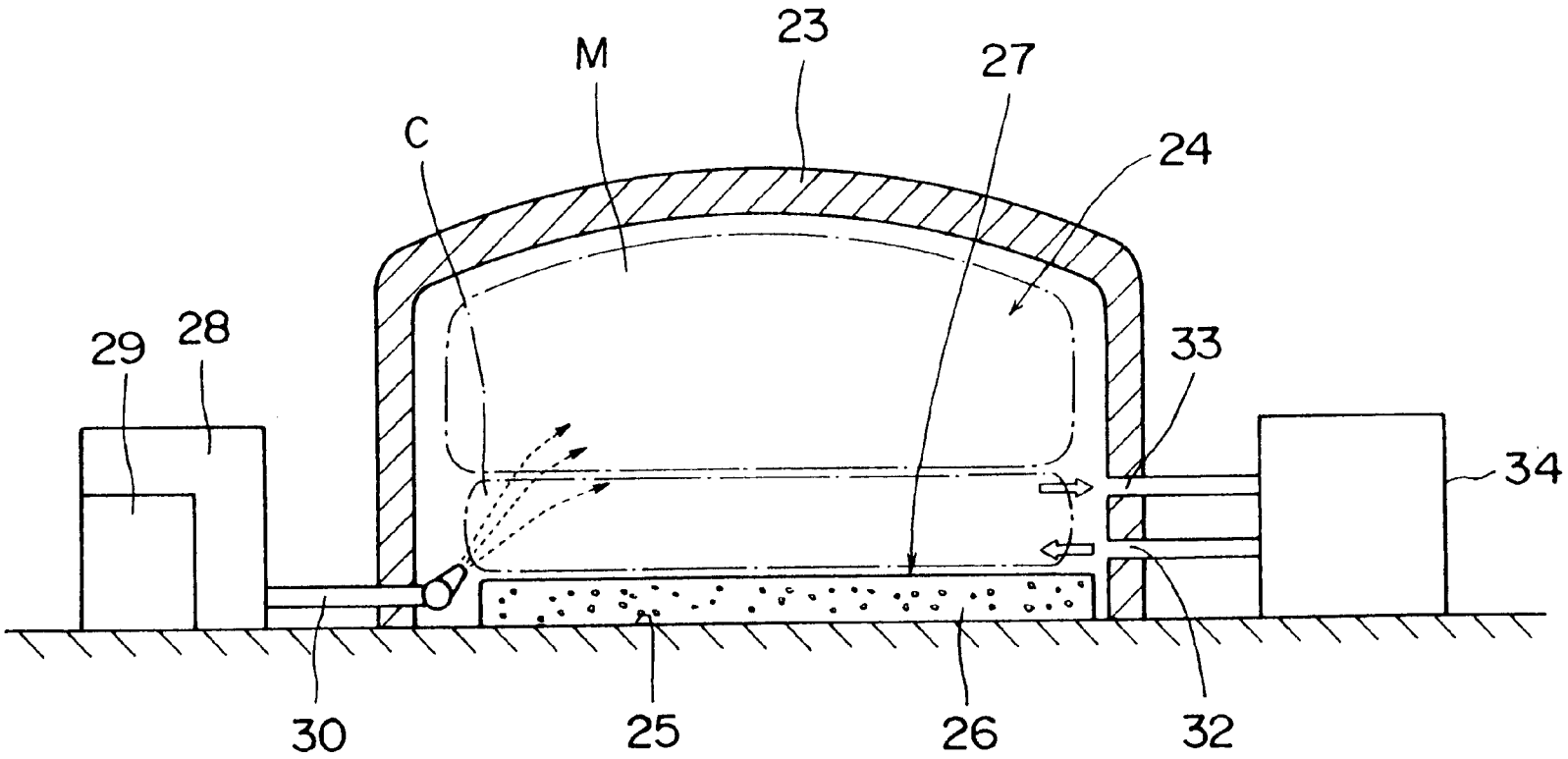
FIG. 7 is a sectional view taken along line VII—VII of FIG. 5.

A dome according to this embodiment has an ordinary temperature spatial region for use as a theme park, a shopping center, etc., and a low temperature spatial region for use as a skiing ground. As shown in FIGS. 5 to 7, a dome 21 is elliptical when viewed from above, and a ceiling portion 23 semicircular relative to a floor surface portion 22 is formed to give a large space 24 inside. The inside of the dome 21 is divided into two parts, one of the parts (left part in FIG. 5) being an ordinary temperature spatial region M such as a theme part, a shopping center, etc., and the other part (right part in FIG. 5) being a low temperature spatial region C for use as an indoor type skiing ground. In the low temperature spatial region C, a slope 25 is formed on the lower surface, and artificial snow 26 is accumulated to a predetermined thickness on the slope 25 to form a ski slope 27.

In this indoor type skiing ground, artificial snow 26 is produced by a snow former 28, and the resulting artificial snow 26 is stored in a snow depository 29. The artificial snow 26 stored in the snow depository 29 is carried (pneumatically or otherwise) to the ski slope 27 by an air carrier 30 to form an artificial snowfall on the ski slope 27. Water resulting from the melting of the artificial snow 26 on the ski slope 27 is gathered to be returned to the snow former 28, by which artificial snow 26 is produced again.

On the floor surface portion 22 of the dome 21, an air dam 31 is formed so as to partition the interior of the dome into the ordinary temperature spatial region M and the low temperature spatial region C by utilizing a difference in height. In a side wall of the dome 21 on the indoor type skiing ground side, many cold air ports 32 are formed at an upper part of and beside the ski slope 27 for blowing cold air into the dome 21. At a lower part of the ski slope 27 and in a side surface portion of the air dam 31, air outlets 33 are formed for discharging air from inside the dome 21. The cold air ports 32 and air outlets 33 are located such that their height positions are close to the surface height position of the artificial snowfall 26 with a predetermined thickness (suitable thickness for skiing) The cold air ports 32 and air outlets 33 are each in the form of an elongated slit extending along the surface of the artificial snowfall 26.

A snow surface cooling air stream control device 34 has a heat exchanger 34*a* and a fan 34*b*, and can supply cold air, cooled to a temperature enough to maintain the quality of artificial snowfall 26 at a satisfactory level (a temperature not reaching −10 to −15° C., e.g., a temperature of −5 to −10° C.), to a plurality of cold air ports 32. This cold air is supplied through each cold air port 32 toward the surface of the ski slope 27. Thus, the surface of the artificial snow 26 is cooled with cold air supplied through the cold air ports 32, and kept in a satisfactory quality without being thawed. The cold air fed toward the surface of the ski slope 27 cools the surroundings (artificial snow 24 and air), heat-exchanges with them, and rises in temperature. This warmed air is then discharged to the outside of the dome 21 through the air outlets 33, and returned to the snow surface cooling air stream control device 34, where heat exchange (cooling) is performed as stated above, and the cooled air is fed again to the ski slope 27 through the cold air ports 32.

At a high position (or near the top) of the air dam 31, slit-like jet nozzles 35 are provided. The direction of jets through the jet nozzles 35 is toward the ski slope 27, and the blowoff temperature of the jets is 20 to 30° C. The jets from the jet nozzles 35 ascend passing over the cold air flowing on the surface of the ski slope 27, and flow into the ordinary temperature spatial region M along the ceiling portion 23 of the dome 21. In this manner, the jets circulate inside the dome 21. In the ceiling portion 23 of the dome 21, discharge holes 36 are provided for discharging air inside the dome 21 to the outside. An air stream control device 37 has a heat exchanger 37*a* and a fan 37*b*. This device 37 can gather air discharges from the dome 21 through the discharge holes 36 to heat-exchange (cool) them and issue as jets through the jet nozzles 35.

Figure 8:
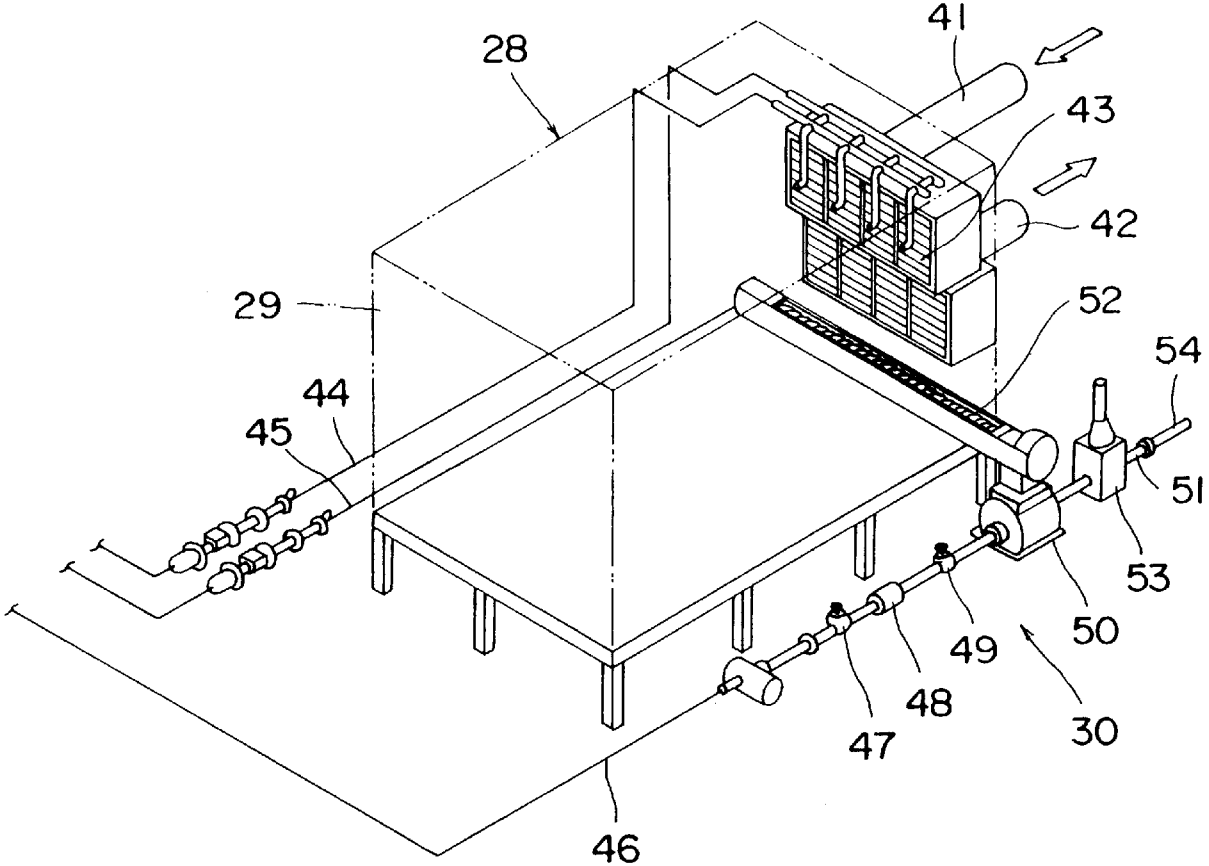
FIG. 8 is a schematic view showing a snow former, a snow depository, and a snow carrier.
Figure 9:
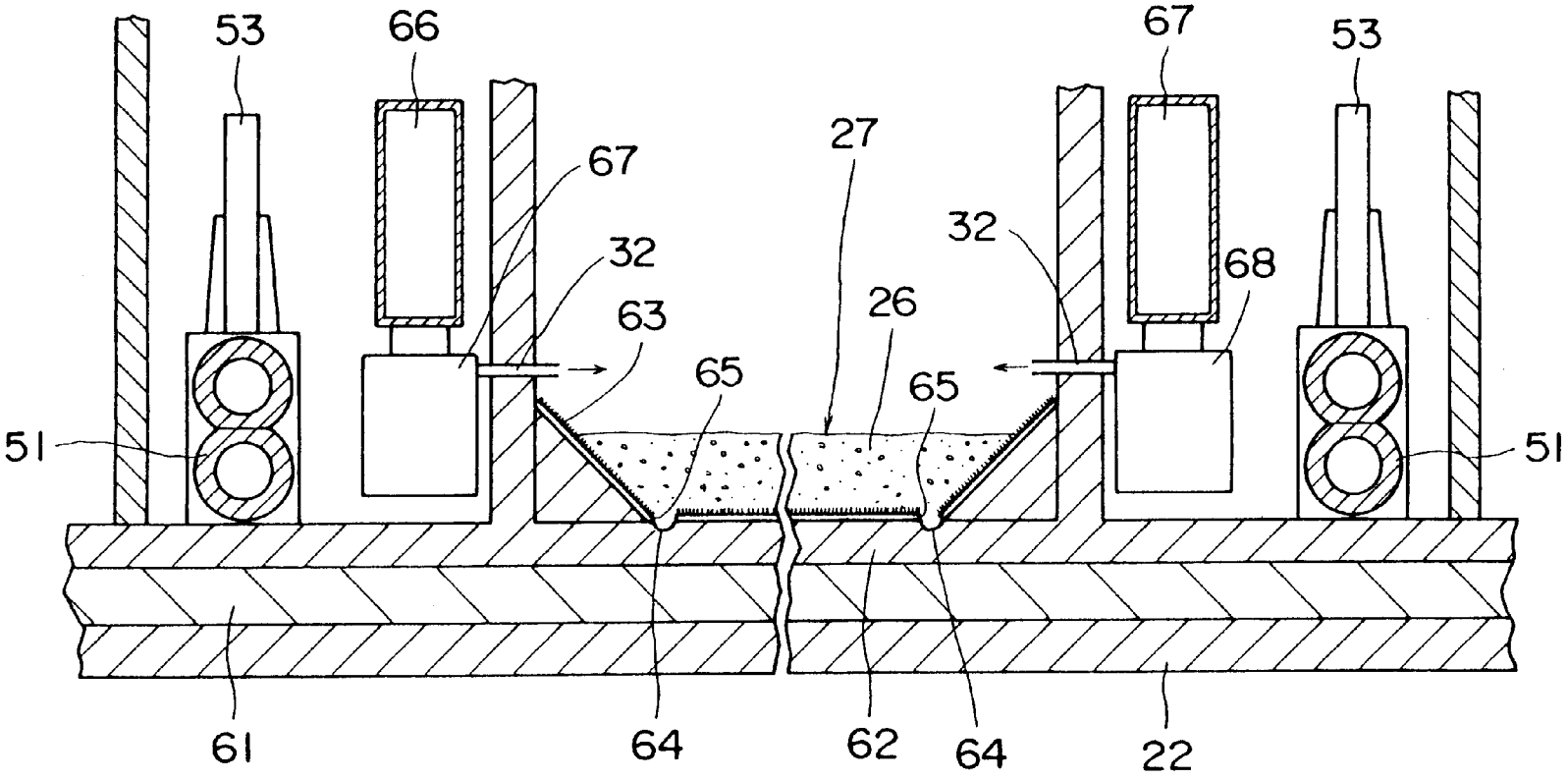
FIG. 9 is a transverse sectional view showing the ski slope structure of the indoor type skiing ground.

The snow former 28, snow depository 29 and snow carrier 30 for providing an artificial snowfall on the ski slope 27 will be described in detail. As shown in FIGS. 8 and 9, in the instant embodiment, the interior of the snow former 28 constitutes the snow depository 29. On a side portion of the snow former 28, a cold air supply pipe 41 and an internal air discharge pipe 42 are mounted. Through a blowoff port 43 inside the snow former 28, cold air of a predetermined temperature can be blown into its entire interior. To the snow former 28, a pressurized water supply pipe 44 and a snow-making compressed air supply pipe 45 are connected. Front end portions of the respective supply pipes 44, 45 are located near the cold air blowoff port 43. Thus, with cold air of a predetermined temperature being blown into the snow former 28 through the blowoff port 43, pressurized water is fed through the pressurized water supply pipe 44 and compressed air is blown off through the snow-making compressed air supply pipe 45. As a result, heat is exchanged between sprayed water and cooled air, whereby the water sprays can be converted into artificial snow and stored in the snow depository 29.

In the snow carrier 30, a snow-carrying compressed air supply pipe 46 is laid adjacent the snow former 28 (snow depository 29), and a snow carriage pipe 51 is connected thereto via a flow meter 47, a pressure regulating valve 48, a pressure gauge 49, and a rotary feeder 50. Inside the snow depository 29, a screw conveyor 52 is disposed, and artificial snow in the snow depository 29 can be supplied to the rotary feeder 50. The snow carriage pipe 51, as shown in detail in FIG. 6, is disposed in the entire area of the ski slope 27, and has snow sprinkler nozzles 54 mounted thereto via a plurality of carriage switching devices 53. Thus, when compressed air is fed from the snow-carrying compressed air supply pipe 46 to the snow carriage pipe 51 and simultaneously artificial snow in the snow depository 29 is fed to the rotary feeder 50, the artificial snow is pressure fed by this compressed air into the snow carriage pipe 51 of the ski slope 27. By operating the carriage switching device 53 at a position where the operator wants snow to be sprinkled, artificial snow can be sprinkled at a predetermined position of the ski slope 27 through the snow sprinkler nozzle 54.

In this case, a ski slope snow accumulation controller 55 is connected to the carriage switching device 53 as shown in FIG. 5. This ski slope snow accumulation controller 55 causes artificial snow to be sprinkled at a predetermined position of the ski slope 27 through the snow sprinkler nozzle 54 by manipulating a predetermined carriage switching device 53 in accordance with the amount of snow accumulation in the entire area of the ski slope 27.

Figure 10:
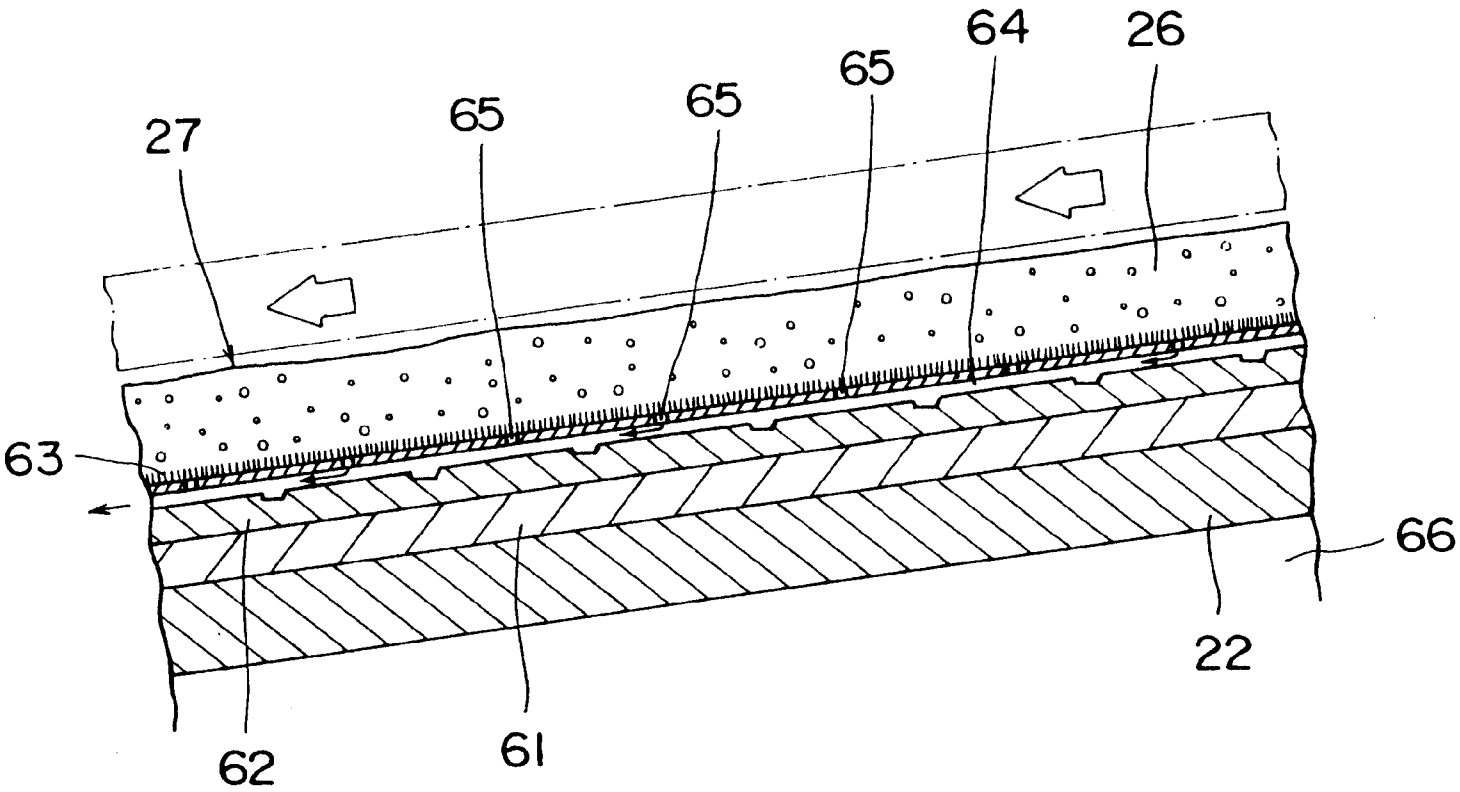
FIG. 10 is a longitudinal sectional view showing the ski slope structure of the indoor type skiing ground.

According to the indoor type skiing ground of the instant embodiment, thawing takes place in a lower surface portion of the artificial snow 26 layer constituting the ski slope 27, while artificial snow 26 is sprinkled over an upper surface portion of the artificial snow 26 layer for replenishment. Hence, the thickness of the artificial snow 26 layer of the ski slope 27 is always constant, and its snow quality is kept satisfactory. That is, as shown in FIGS. 9 and 10, the floor surface portion 22 of the dome 21 is made of concrete. On the floor surface portion 22, a concrete floor 62 is formed via a urethane insulation 61 as a heat insulating member. On the concrete floor 62, an artificial lawn 63 is laid, and artificial snow 26 is accumulated on the artificial lawn 63 to a predetermined thickness. At an upper surface of the concrete floor 62 and under the artificial lawn 63, meltwater channels 64 are formed in the direction of inclination of the slope 25. In the artificial lawn 63, a plurality of through-holes 65 communicating with the meltwater channels 64 are formed. Below the floor surface portion 22 made of concrete, there is a machine room 66 as a heat source. In FIG. 9, the reference numeral 67 represents a duct for supplying cold air from the snow surface cooling air stream control device 34 to the cold air port 32, and the reference numeral 68 denotes a cold air chamber.

Hence, heat transferred from the machine room 66 is conducted to the floor surface portion 22, urethane insulation 61, concrete floor 62 and artificial lawn 63 to act on the lower surface portion of the artificial snow 26. Consequently, the artificial snow 26 melts, beginning on the lower surface portion side. The resulting meltwater passes through the through-holes 65 of the artificial lawn 63, reaching the meltwater channels 64 and flowing there downward. In this case, the thickness of the urethane insulation 62 is set to be in agreement with the amount of snow thawed in the lower surface portion of the artificial snow 26 in the ski slope 27, and in consideration of the thermal conductivity obtained during heat conduction from the machine room 66 to the lower surface portion of the artificial snow 26.

In the so constituted dome 21 of the instant embodiment, as shown in FIGS. 5 and 6, the snow surface cooling air stream control device 34 supplies cold air of, say, −5 to −10° C., enough to maintain the quality of the artificial snow 26 at a good level, from the plurality of cold air ports 32 toward the surface of the ski slope 27. The surface of the artificial snow 26 is cooled with this cold air, so that it is free from thawing and its quality is kept satisfactory. The cold air fed toward the surface of the ski slope 27 flows downward along the surface of the ski slope 27, and exchanges heat with the surface to rise in temperature. The warmed air passes through the air outlets 33, and returns to the snow surface cooling air stream control device 34. In this device 34, the warmed air undergoes heat exchange (cooling), whereafter the cooled air is supplied again to the ski slope 27 through the cold air ports 32.

The air stream control device 37, on the other hand, directs jets of, say, 20 to 30° C., which will keep the inside of the dome 21 at an ordinary temperature, toward the ski slope 27 through the plurality of jet nozzles 35. These jets ascend passing over the cold air flowing on the surface of the ski slope 27, and circulate along the ceiling portion 23 of the dome 21 to divide the inside of the dome 21 into the ordinary temperature spatial region M and the low temperature spatial region C. Part of the air stream flowing along the ceiling portion 23 of the dome 21 is passed through the discharge holes 36, and returned to the air stream control device 37, where it is heat-exchanged (cooled) and injected again as jets toward the ski slope 27 through the jet nozzles 35.

In the ski slope 27 of the indoor type skiing ground, as shown in FIG. 10, the thickness of the urethane insulation 62 is set to be in agreement with the amount of snow thawed in the lower surface portion of the artificial snow 26. Heat transferred from the machine room 66 is conducted to the floor surface portion 22, urethane insulation 61, concrete floor 62 and artificial lawn 63 to act on the lower surface portion of the artificial snow 26. Consequently, the artificial snow 26 melts on the lower surface portion side. The resulting meltwater passes through the through-holes 65 of the artificial lawn 63, falling to the meltwater channels 64 and flowing there downward.

In the snow former 28, with cold air being blown into its inside through the blowoff port 43, water is sprayed by the action of pressurized water and compressed air. As a result, heat is exchanged between sprayed water and cooled air, whereby artificial snow is produced and stored in the snow depository 29. When compressed air is fed by the snow carrier 30 to the snow carriage pipe 51 and simultaneously artificial snow in the snow depository 29 is fed to the rotary feeder 50 by the screw conveyor 52, the artificial snow is pressure fed by this compressed air into the snow carriage pipe 51 of the ski slope 27. This artificial snow is sprinkled over the ski slope 27 through the snow sprinkler nozzle 54.

In this case, the artificial snow 26 of the ski slope 27 is thawed, beginning on the lower surface portion side, by transferred heat. The ski slope snow accumulation controller 55 operates a predetermined carriage switching device 53 in accordance with the amount of snow accumulation at each position of the ski slope 27, thereby causing artificial snow to be sprinkled at a predetermined position of the ski slope 27 through the snow sprinkler nozzle 54. By so replenishing artificial snow, the thickness of the artificial snow 26 of the ski slope 27 can be always maintained at a constant level.

In the foregoing embodiment, the snow former 28, snow depository 29 and snow carrier 30 are not restricted to the indicated structures, but their structures can be changed or modified depending on the location of, or the conditions for, their installation.

As described above, according to the indoor type skiing ground of the present invention, artificial snow produced by the snow former and stored transiently in the depository is carried by the snow carrier to the ski slope and sprinkled by the snow sprinkler. Thus, there is no need to make snow inside the building. It suffices for the ski slope cooler to perform cooling simply by supplying cold air to the vicinity of the surface height of the artificial snow constructed. Hence, the cooler can be downsized to reduce the energy cost. Also, the ski slope snow accumulation controller can sprinkle artificial snow only in a predetermined area of the ski slope in accordance with the amount of snow accumulation in the ski slope. The ski slope can be always maintained with an artificial snowfall of a preferred predetermined thickness. Furthermore, fresh snow is always fed at a required position of the ski slope where a satisfactory snow quality is demanded. The supply of cold air to the ski slope, coupled with feed of fresh snow, can inhibit the granulation of snow due to coarse grains of accumulated snow, and can effectively maintain a high quality of snow without cooling the entire space of the skiing ground.

According to the indoor type skiing ground of the present invention, moreover, artificial snow is sprinkled to a predetermined thickness on the slope inside the building, whereby the ski slope can be formed. Below the artificial snowfall constituting the ski slope, the heat insulating member is provided. The thickness of the heat insulating member is set such that the lower surface portion of the artificial snowfall is thawed by a predetermined thickness by the action of heat transferred via the heat insulating member. Thus, there is no need to use a machine for scraping off the deteriorated artificial snow on the surface of the ski slope, or a carrier for carrying the scraped snow. Nor is it necessary to forbid ski glides by shutting off the ski slope. The snow quality of the ski slope can always be maintained to be high, by a simple and inexpensive structure.

<Fourth Embodiment>

Figure 11:
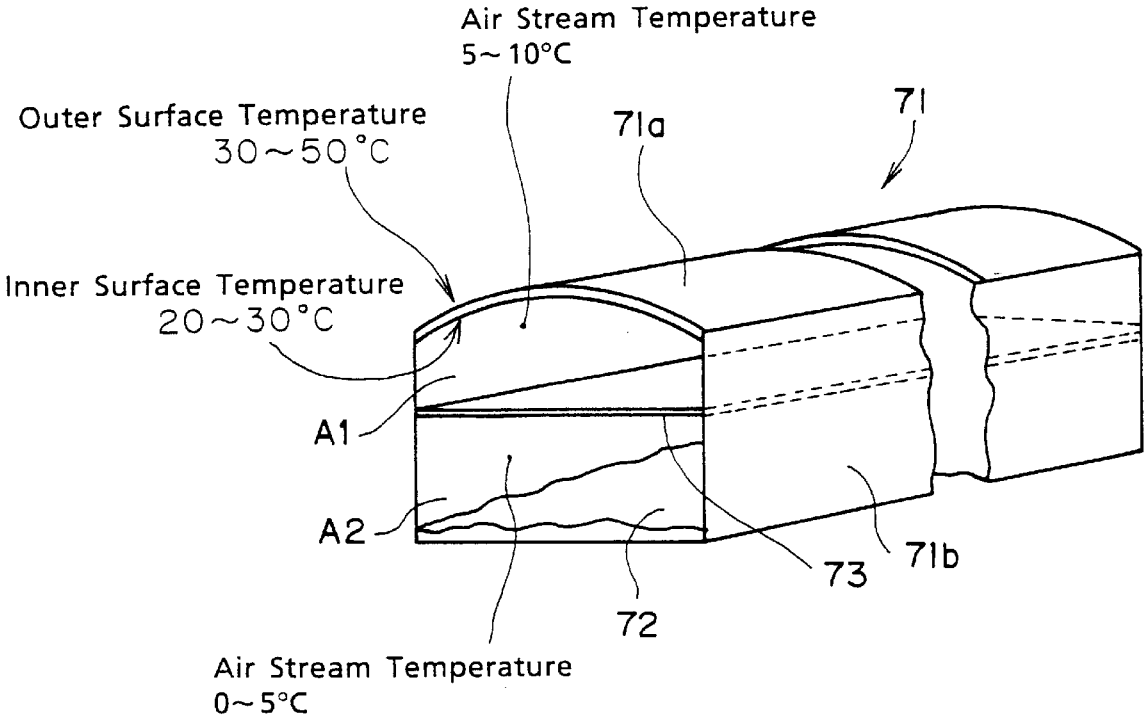
FIG. 11 is a schematic view showing an internal structure of an indoor type skiing ground related to a fourth embodiment of the present invention.

An indoor type skiing ground of this embodiment has a snow surface 72, which constitutes a ski slope, in an inclined condition on a floor surface of the inside of a building 71, as shown in FIG. 11. The building 71 has a ceiling 71*a*, which is a dome-shaped roof, and a side wall 71*b*. Inside the building 71, a partition member 73 is placed. This partition member 73 partitions the indoor space of the building 71 into an upper space A1 on the ceiling 71*a* side, and a lower space A2 on the snow surface 72 side. As the partition member 73, a metal plate, a cloth, or a thin plate formed of an organic material or an inorganic material can be used.

Cooling is effected such that the air stream temperature of the lower space A2 is set at 0 to 5° C., while the air stream temperature of the upper space A1 is set at 5 to 10° C. This means that, unlike earlier technologies, neither the space A1 nor the space A2 is cooled to a temperature lower than the temperature of the snow surface 72 (e.g., to a temperature of −2 to −5° C.). In the middle of summer, the temperature of the outer surface of the ceiling 71*a* amounts to 30 to 50° C., while the temperature of the inner surface of the ceiling 71*a* is 20 to 30° C. because of cooling with the air of the upper space A1.

In the instant embodiment, since the partition member 73 is disposed, radiant heat from the ceiling 71*a* is blocked by the partition member 73 and does not reach the snow surface 72. Thus, thawing of the snow surface 72 due to radiant heat from the ceiling 71*a* can be prevented. Hence, the temperature of the lower space A2 is kept at 0 to 5° C. (a temperature higher than the temperature of the snow surface 72), whereby the snow quality of the snow surface 72 can be held satisfactory.

In this embodiment, as noted above, the indoor spaces A1 and A2 need not be overcooled to temperatures lower than the temperature of the snow surface 72.

Namely, the air stream temperature of the lower space A2 is set at 0 to 5° C., while the air stream temperature of the upper space A1 is set at 5 to 10° C. Thus, the refrigerating capacity can be made low. Especially, the upper space A1 may be held at 5 to 10° C., so that the refrigerating capacity can be made low as a whole. Even when the refrigerating capacity is small, the temperature of the lower space A2 is kept at 0 to 5° C. Thus, the snow quality of the snow surface 72 can be held high, and the frequency of replenishing fresh snow can be decreased.

The partition member 73 is also cooled. Thus, the partition member 73 need not be a special material with a small emissivity, but may be a general purpose article such as a metal plate. Nor is it necessary to choose a special material with a small emissivity as the ceiling 71*a*, which may be a conventionally used general purpose article. From these aspects, the instant embodiment can be achieved at a low cost. Furthermore, the partition member 73 can be installed easily, and this technique is applicable easily to the existing skiing grounds as well as newly built indoor skiing grounds.

Earlier technologies and the present invention will be studied comparatively with emphasis on the action of radiant heat.

Generally, radiant heat occurs between substances of different temperatures, and involves heat exchange regardless of the distance therebetween. Let the quantity of heat exchanged per unit area be q. The quantity of heat exchange, q, is given by the formula $$q = \varepsilon_1 \cdot \varepsilon_2 \cdot \sigma(T_1^4 - T_2^4)$$

where $\epsilon_1$ and $\epsilon_2$ represent the emissivities of both substances, $\sigma$ represents Boltzmann's constant, and $T_1$ and $T_2$ represent the surface temperatures of both substances.

The emissivity of the snow surface 72 is close to that of a blackbody, and is nearly 1. To decrease this emissivity, it is recommendable to decrease the emissivity of the substance opposed to the snow surface 72 or equate both temperatures.

A technique for decreasing the emissivity of the substance opposed to the snow surface 72 corresponds to a conventionally studied technique for selecting a material with a small emissivity as the material for the ceiling 71*a*. Even if it was attempted to do so, however, aged deterioration or adverse influence on the lighting occurred, making it impossible to provide a satisfactory material actually. A technique for equalizing the temperature of the substance opposed to the snow surface 72 with the temperature of the snow surface 72 corresponds to a technique for overcooling the indoor space to make the temperature of the ceiling 71*a* or the side wall 71*b* equal to the snow surface temperature as done with earlier technologies. So doing requires an extremely high refrigerating capacity.

In the case of the present embodiment, the movement of heat expressed by the above equation takes place between the ceiling 71*a* and the partition member 73 and between the partition member 73 and the snow surface 72. In this case, the partition member 73 is cooled with the cold air of the spaces A1 and A2. The difference between the temperature of the snow surface 72 and the temperature of the lower space A2 is as small as several degrees centigrade (not more than 10° C.), so that the thawing of the snow surface 72 is very limited.

As described above, according to the indoor skiing ground of the present invention, the partition member is disposed inside the building, where a snow surface is formed on the floor surface, thereby to partition the indoor space of the building vertically into two spaces, the space on the ceiling side of the building, and the space on the snow surface side. Thus, radiant heat from the ceiling is blocked by the partition member, so that thawing of the snow surface due to radiant heat can be prevented. The blocking of the radiant heat by the partition member can also obviate the need to overcool the indoor space, and can thus make the refrigerating capacity low. Of course, the snow quality of the snow surface can be held satisfactory.

<Fifth Embodiment>

An indoor type skiing ground of this embodiment is the same as the indoor type skiing ground of the aforementioned third embodiment in the basic structure. Members having the same functions as described in the third embodiment are assigned the same numerals or symbols, and overlapping explanations will be omitted.

Figure 12:
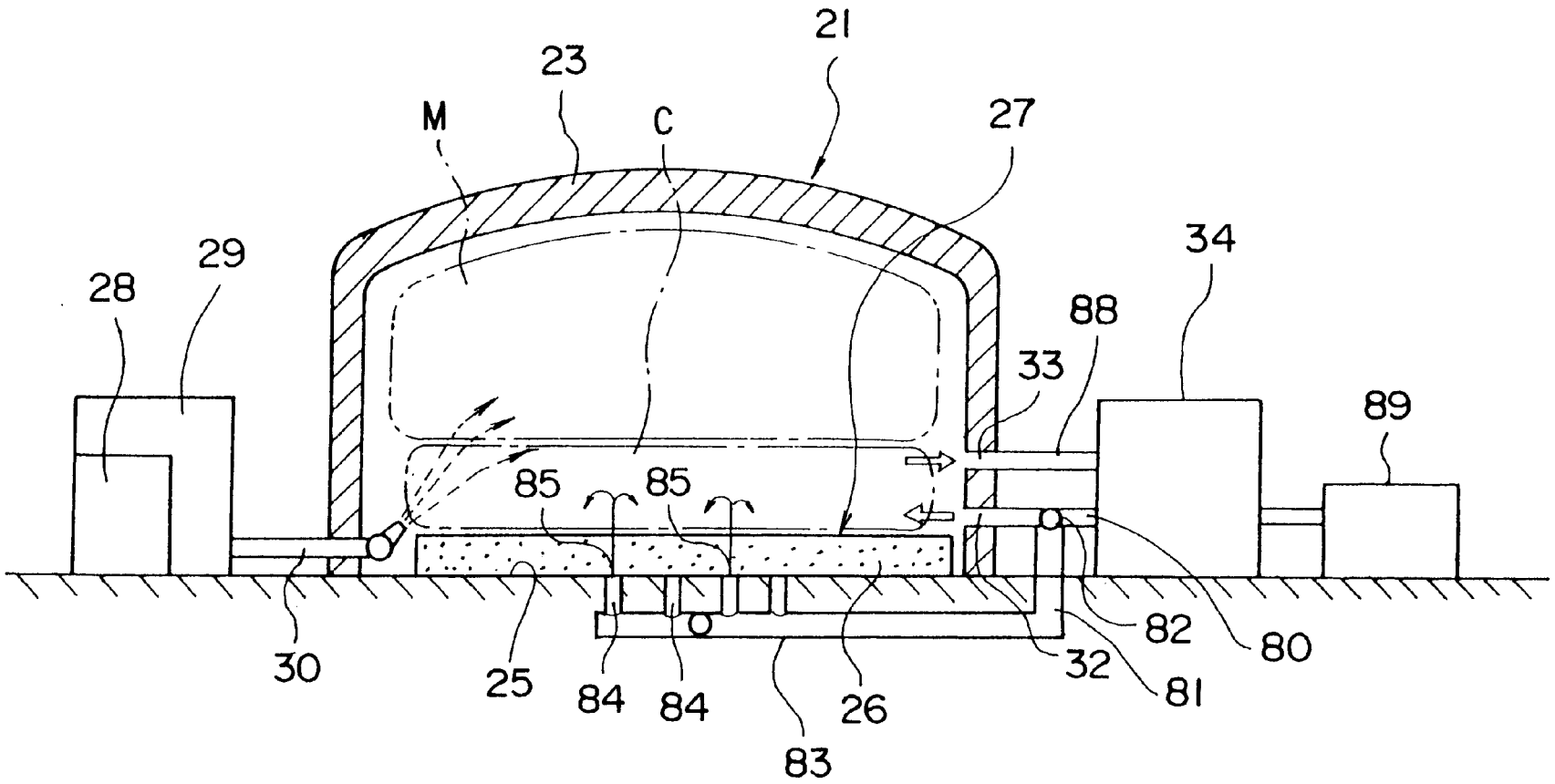
FIG. 12 is a schematic sectional view of an indoor type skiing ground related to a fifth embodiment of the present invention.

In this embodiment, as illustrated in FIG. 12, an indoor type skiing ground dome 21 has a ceiling portion 23 semicircular relative to a slope 25, thus giving an upper ordinary temperature spatial region M and a lower low temperature spatial region C. On the slope 25 in the low temperature spatial region C, artificial snow 26 is accumulated to a predetermined thickness to form a ski slope 27. This indoor type skiing ground is equipped with a snow former 28, a snow depository 29, and a snow carrier 30.

Figure 13:
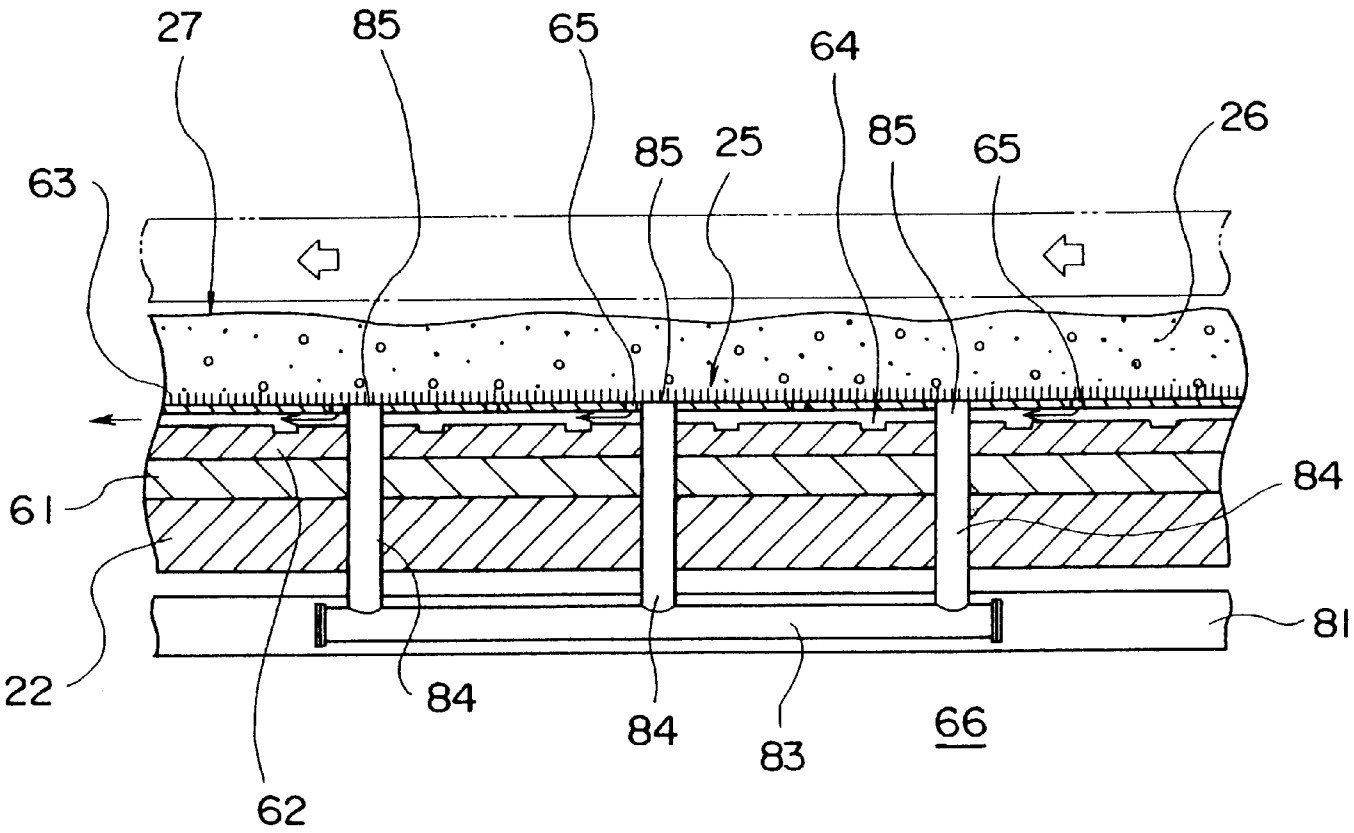
FIG. 13 is a sectional view showing the ski slope structure of the indoor type skiing ground.

In this indoor type skiing ground, as shown in FIG. 13, a concrete floor 62 is formed on a floor surface portion 22 made of concrete via a urethane insulation 61. On the concrete floor 62, an artificial lawn 63 is laid, and artificial snow 26 is accumulated on the artificial lawn 63 to a predetermined thickness, thereby forming the ski slope 27. At an upper surface of the concrete floor 62, meltwater channels 64 are formed in the direction of inclination of the slope 25. In the artificial lawn 63, a plurality of through-holes 65 communicating with the meltwater channels 64 are formed.

A snow surface cooling air stream control device 34, on the other hand, has an air conditioner with a heat exchanger and a fan (neither shown), and supplies cold air, cooled to a temperature enough to keep the quality of the artificial snow 26 satisfactory (e.g., to a temperature of −5 to −10° C.), to the surface of the ski slope 27. By so doing, this device 34 cools the surface of the artificial snow 26, minimizes thawing of snow, and maintains the snow quality at a satisfactory level.

Figure 14:
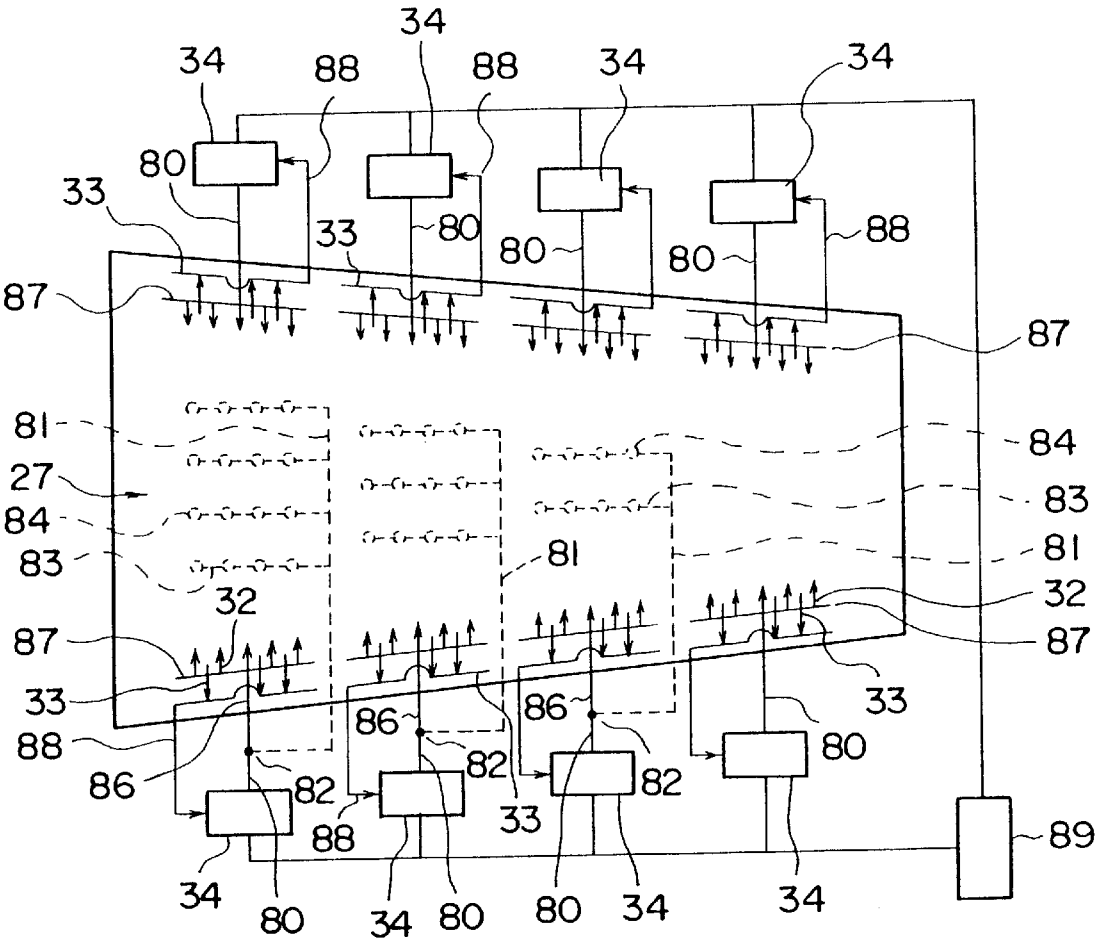
FIG. 14 is a plan view showing the arrangement of cold air blowoff ports in the ski slope.

That is, as shown in FIGS. 12 to 14, a lagged main pipe 81 for distributing cold air from a cold air supply pipe 80 of the snow surface cooling air stream control device 34 is disposed below the floor surface portion 22 of the ski slope 27 via a pressure control valve 82. Via a branch pipe 83 connected to the main pipe 81, many air gun type blowoff pipes 84 are branched at a central part of the ski slope 27. The blowoff pipe 84 pierces through the floor surface portion 22, urethane insulation 61 and concrete floor 62, and has a blowoff port 85 open at a lower surface of the artificial lawn, thereby preventing snow from entering the blowoff pipe 84. Cold air supplied through the blowoff port 85 is pressurized (e.g., at about 2 kg/cm$^2$), pierces through the artificial lawn 63 and the artificial snow 26 laid thereon, and blows over the snow surface to cover it. As a result, it cools the snow surface, which receives heat from the lighting, skiers, etc., to about 2° C. Since the blowoff pipe 84 is of an air gun type, a hole drilled thereby in the ski slope 27 is small and does not impede skiing. The main pipe 81 and the branch pipe 83 may be provided on the concrete floor 62.

In a side wall of the indoor type skiing ground dome 21 that extends along the ski slope 27, lagged subsidiary pipes 86 of a different line are each disposed for distributing cold air from the cold air supply pipe 80 of the snow surface cooling air stream control device 34. In mother pipes 87 on both side walls connected to the lagged subsidiary pipes 86, many cold air ports 32 for blowing cold air toward the snow surface are each provided in an elongated slit form extending along the surface of the artificial snow 26. In the side wall surrounding the ski slope 27, air outlets 33 are formed for discharging air from inside the dome. The height position of the air outlet 33 is slightly higher than the position of the cold air port 32 so that cold air blown off through the blowoff ports 85 and cold air ports 32 becomes an air stream over the snow surface to cool the surface of the artificial snow 26, and is then recovered by the snow surface cooling air stream control device 34 via a return pipe 88. A cold air blow through the main pipe 81 has a higher blowoff resistance than a cold air blow through the subsidiary pipe 86. Thus, the cold air pressure inside the main pipe 81 is controlled to be high by the pressure control valve 82.

Hence, the snow surface cooling air stream control device 34 supplies cold air, enough to maintain the quality of the artificial snow 26 at a high level, to the blowoff ports 85 and the cold air ports 32 to feed the cold air toward the surface of the ski slope 27. This cold air cools the surface of the artificial snow 26, keeps snow thawing to the minimum, and holds the snow quality satisfactory. The cold air fed toward the surface of the ski slope 27 cools the surroundings (artificial snowfall 26 and air), and while heat-exchanging with them, flows along the surface of the ski slope 27 as an air stream running over the snow surface. Then, the warmed air is passed through the air outlets 33 and return pipe 88, and returned to the snow surface cooling air stream control device 34. In this device 34, heat exchange (cooling) is performed, and the cooled air is supplied again to the ski slope 27 through the blowoff ports 85 and the cold air ports 32. The reference numeral 89 denotes a heat source for supplying a coolant to the heat exchanger of the snow surface cooling air stream control device 34.

According to this embodiment, as noted above, air is jetted toward regions above the snow surface through the plurality of blowoff ports 85, which are open at the lower surface of the artificial lawn, while passing through the artificial snow 26 on the slope 25. At the same time, cold air is blown toward the snow surface through the cold air ports 32 provided in the side wall extending along the ski-slope 27. Thus, a thin cold air layer is formed on the snow surface. This thin cold air layer cuts off heat input from heat of the space inside the dome 21, thus making it possible to reduce the amount of snow thawed in the ski slope 27 and keep the quality of snow in the ski slope 27 satisfactory. Moreover, there is no need to make the entire air inside the dome 21 as cold as in the middle of winter. Thus, skiers can enjoy skiing in relatively light clothing, and the energy consumption in the dome can be kept low. Furthermore, cold air can be supplied on necessary occasions at necessary sites without interrupting skiers.

In the instant embodiment, moreover, supply of cold air can be diversified. Depending on situations, cold air can be supplied in a supplemental manner through the cold air ports 32 with a relatively low blowoff resistance that are arranged along the portion beside the slope.

Figure 15:
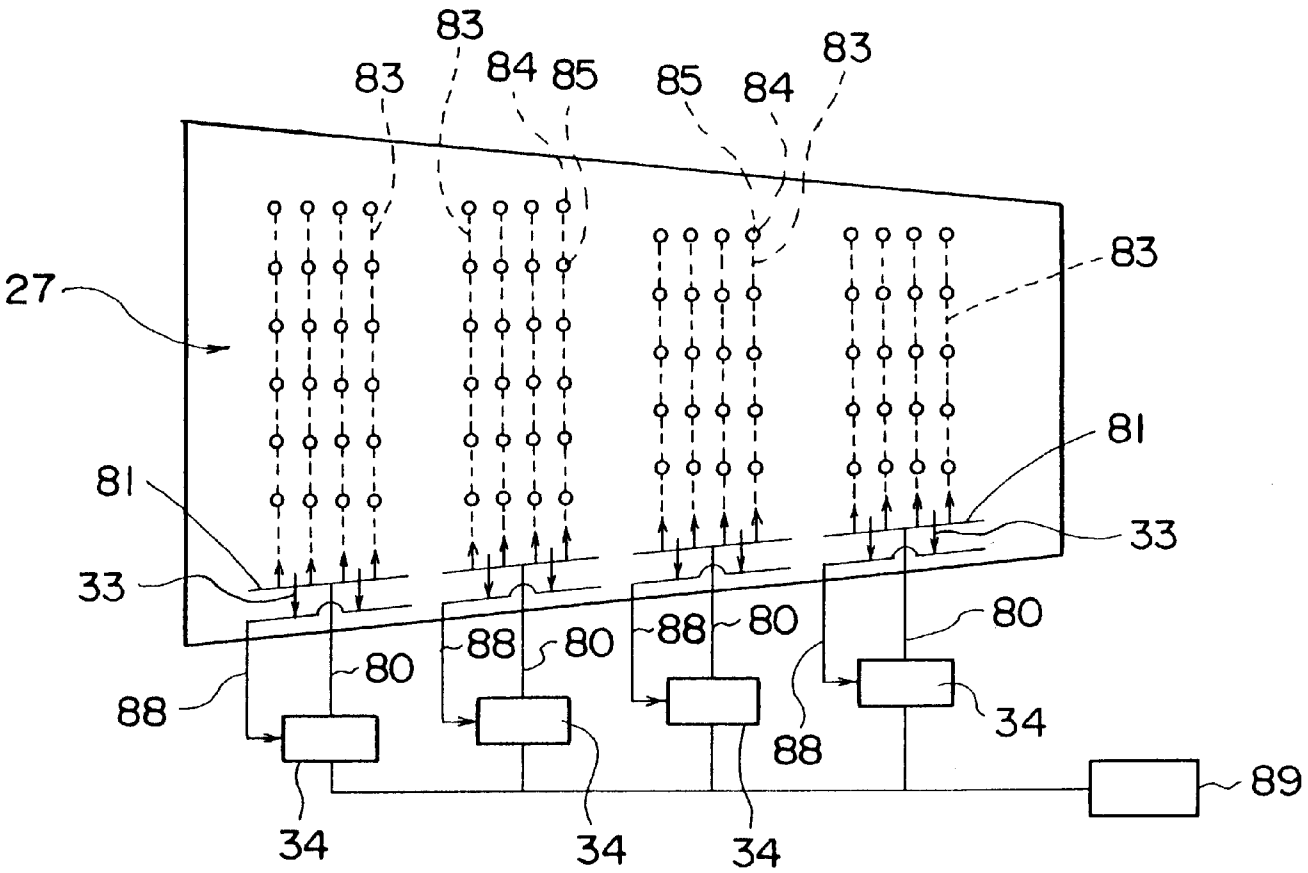
FIG. 15 is a plan view showing the arrangement of cold air blowoff ports in a modified example of the ski slope structure of the indoor type skiing ground.

According to the above-mentioned embodiment, cold air is supplied toward the surface of the ski slope 27 by the snow surface cooling air stream control device 34 through the blowoff ports 85 and the cold air ports 32 to cool the surface of the artificial snow 26 and keep a high quality of snow. However, it is permissible to eliminate the cold air ports 32 which give a lateral blow of cold air. That is, as shown in FIG. 15, blowoff pipes 84 are connected via a plurality of branch pipes 83 to a lagged main pipe 81 branched from a cold air supply pipe 80 of a snow surface cooling air stream control device 34, whereby the blowoff pipes 84 cover the whole surface of the ski slope 27. At an upper end portion of each blowoff pipe 84, a blowoff port 85 is formed. Thus, the blowoff ports 85 are arranged almost throughout the surface of the ski slope 27, so that the aforementioned lagged subsidiary pipes, mother pipes and pressure control valves can be eliminated to simplify the piping constitution. The main pipe 81 and the branch pipes 83 are located between the artificial lawn and the concrete floor, and it is possible to make the blowoff pipe 84 very short or form the blowoff port 85 directly in the branch pipe 83.

According to the indoor skiing ground of the present invention described above, cold air jets at a high speed toward regions above the snow surface through the plurality of blowoff ports, which are open above the slope and below the accumulated snow, while piercing through the snow accumulated on the slope, thereby to form a thin layer of cold air on the snow surface. This thin cold air layer cuts off heat input from heat of the space inside the building, thus making it possible to reduce the amount of snow thawed in the ski slope and keep the quality of snow in the ski slope satisfactory. Moreover, there is no need to make the entire air inside the building as cold as in the middle of winter. Thus, skiers can enjoy skiing in relatively light clothing, and the energy consumption in the building can be kept low. Furthermore, cold air can be supplied on necessary occasions at necessary sites without interrupting skiers.

<Sixth Embodiment>

An indoor type skiing ground of this embodiment is the same as the indoor type skiing ground of the aforementioned third and fifth embodiments in the basic structure. Members having the same functions as described in these embodiments are assigned the same numerals or symbols, and overlapping explanations will be omitted.

Figure 16:
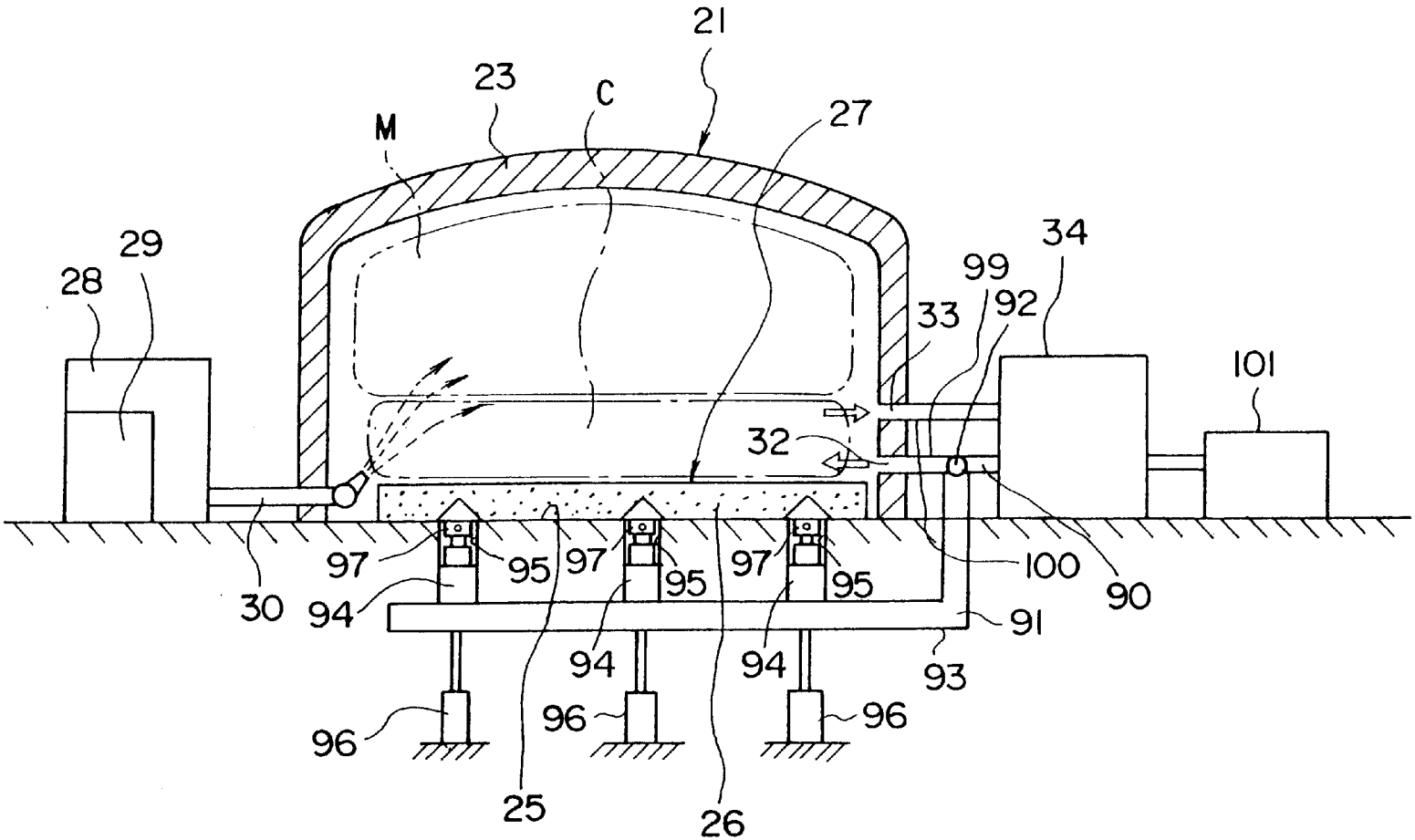
FIG. 16 is a schematic sectional view of an indoor type skiing ground related to a sixth embodiment of the present invention.
Figure 17:
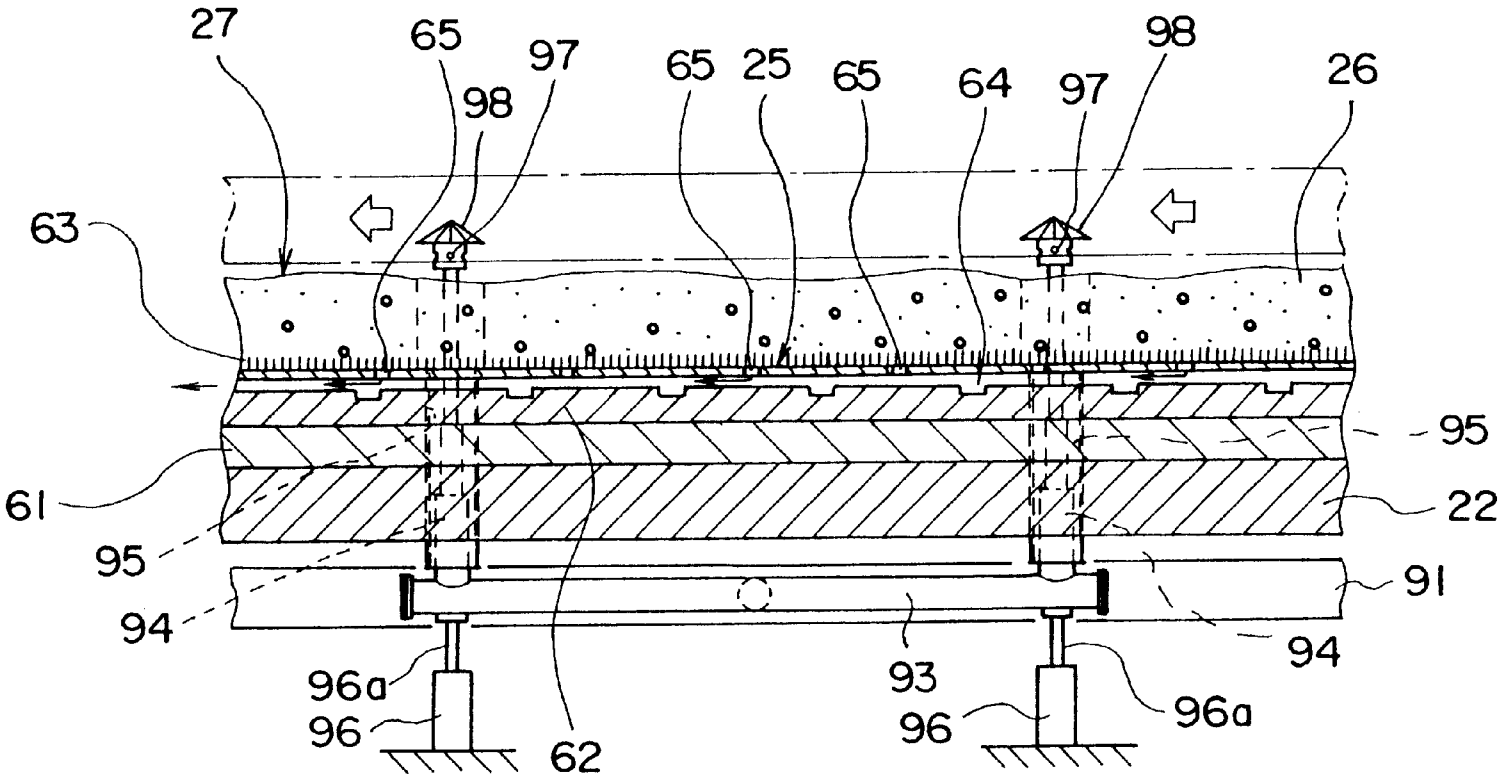
FIG. 17 is a sectional view showing the ski slope structure of the indoor type skiing ground.

As shown in FIGS. 16 and 17, a lagged main pipe 91 for distributing cold air from a cold air supply pipe 90 of a snow surface cooling air stream control device 34 is disposed below a floor surface portion 22 of a ski slope 27 of an indoor type skiing ground dome 21 via a pressure control valve 92. Via a branch pipe 93 connected to the main pipe 91, many expansion pipes 94 with cold air blowoff nozzles are branched at a central part of the ski slope 27. The expansion pipes 94 are arranged with nearly equal spacing throughout the ski slope 27, and when not in use, each of them is housed in a contracted state in a hole 95 which pierces through the floor surface portion 22, a urethane insulation 61 and a concrete floor 62. When cold air is supplied, as indicated by a dashed line in FIG. 17, the expansion pipe 94 is extended by the extending action of an expanding/contracting cylinder 96 to protrude a cold air blowoff nozzle 97 at its top end to a site near and above the snow surface through the hole 95 of the accumulated artificial snow 26. Cold air is blown over the snow surface through the nozzle 97 to cover the snow surface with a thin layer of cold air. The thin cold air layer blocks radiant heat from the ceiling, side wall, etc., and cools the snow surface to about 2° C. To the top surface of the nozzle 97, an artificial lawn is glued to give a larger cover 98 than the hole 95. An operating rod 96*a* of the expanding/contracting cylinder 96 fixed to the inside of a machine room 66 extends into the expansion pipe 94 from below the branch pipe 93 via a seal, and is connected to the nozzle 97.

In a side wall of the indoor type skiing ground dome 21 that extends along the ski slope 27, lagged subsidiary pipes 99 of a different line are each disposed for distributing cold air from the cold air supply pipe 90 of the snow surface cooling air stream control device 34. In mother pipes on both side walls connected to the lagged subsidiary pipes 99, many cold air ports 32 for blowing cold air toward the snow surface are each provided in an elongated slit form extending along the surface of the artificial snow 26. In the side wall surrounding the ski slope 27, air outlets 33 are formed for discharging air from inside the dome.

Hence, the snow surface cooling air stream control device 34 supplies cold air, enough to maintain the quality of the artificial snow 26 at a high level, to the nozzles 97 and the cold air ports 32. The nozzles 97 and the cold air ports 32 are used differently such that during the daytime business hours, strongly low temperature cold air is supplied only through the cold air ports 32, while during non-business hours such as the nighttime, low temperature cold air is supplied only through the nozzles 97, whereby the entire snow surface of the ski slope 27 is maintained at 2° C. or less. This manner of operation can reduce energy consumption markedly while preventing the granulation of snow or the occurrence of a frozen ski slope. This is in contrast to the earlier technology by which even during non-business hours such as the nighttime, strongly low temperature cold air is supplied through the cold air supply pipe to cool the central part of the ski slope 27. In the case of a wide ski slope 27, the nozzles 97 may be protruded here and there in the central part of the ski slope 27 with the nozzles being surrounded with covers to protect skiers. Such sporadically arranged nozzles may be used during the daytime business hours. When the nozzles 97 are disposed in the middle part of the ski slope, but not in its side parts, these nozzles 97 in the middle part may be used in combination with the nighttime supply of weakly low temperature cold air through the cold air ports 32.

This cold air is supplied toward the surface of the ski slope 27 through the nozzles 97 and the cold air ports 32 to cool the surface of the artificial snow 26, keep snow thawing to the minimum, and hold the snow quality satisfactory. The cold air fed toward the surface of the ski slope 27 cools the surroundings (artificial snow 26 and air), and while heat-exchanging with them, flows along the surface of the ski slope 27 as an air stream running over the snow surface. Then, the warmed air is passed through the air outlets 33 and return pipe 100, and returned to the snow surface cooling air stream control device 34. In this device 34, heat exchange (cooling) is performed, and the cooled air is supplied again to the ski slope 27 through the nozzles 97 and the cold air ports 32. The reference numeral 101 denotes a heat source for supplying a coolant to the heat exchanger of the snow surface cooling air stream control device 34.

According to this embodiment, as noted above, cold air is jetted toward regions above the snow surface through the nozzles 97, which, where necessary, protrude over the slope 25. At the same time, cold air is blown toward the snow surface through the cold air ports 32 provided in the side wall extending along the ski slope 27. Thus, a thin layer of cold air is formed on the snow surface. This cold air layer cuts off heat input from the heat of the space inside the dome 21, thus making it possible to reduce the amount of snow thawed in the ski slope 27 and keep the quality of snow in the ski slope 27 satisfactory. Moreover, there is no need to make the entire air inside the dome 21 as cold as in the middle of winter. Thus, skiers can enjoy skiing in relatively light clothing, and the energy consumption in the dome can be kept small. Furthermore, cold air can be supplied on necessary occasions at necessary sites without interrupting skiers.

In the instant embodiment, moreover, supply of cold air can be diversified. Depending on situations, cold air can be supplied in a supplemental manner through the cold air ports 32 with a relatively low blowoff resistance that are arranged along the portion beside the slope.

Figure 18:
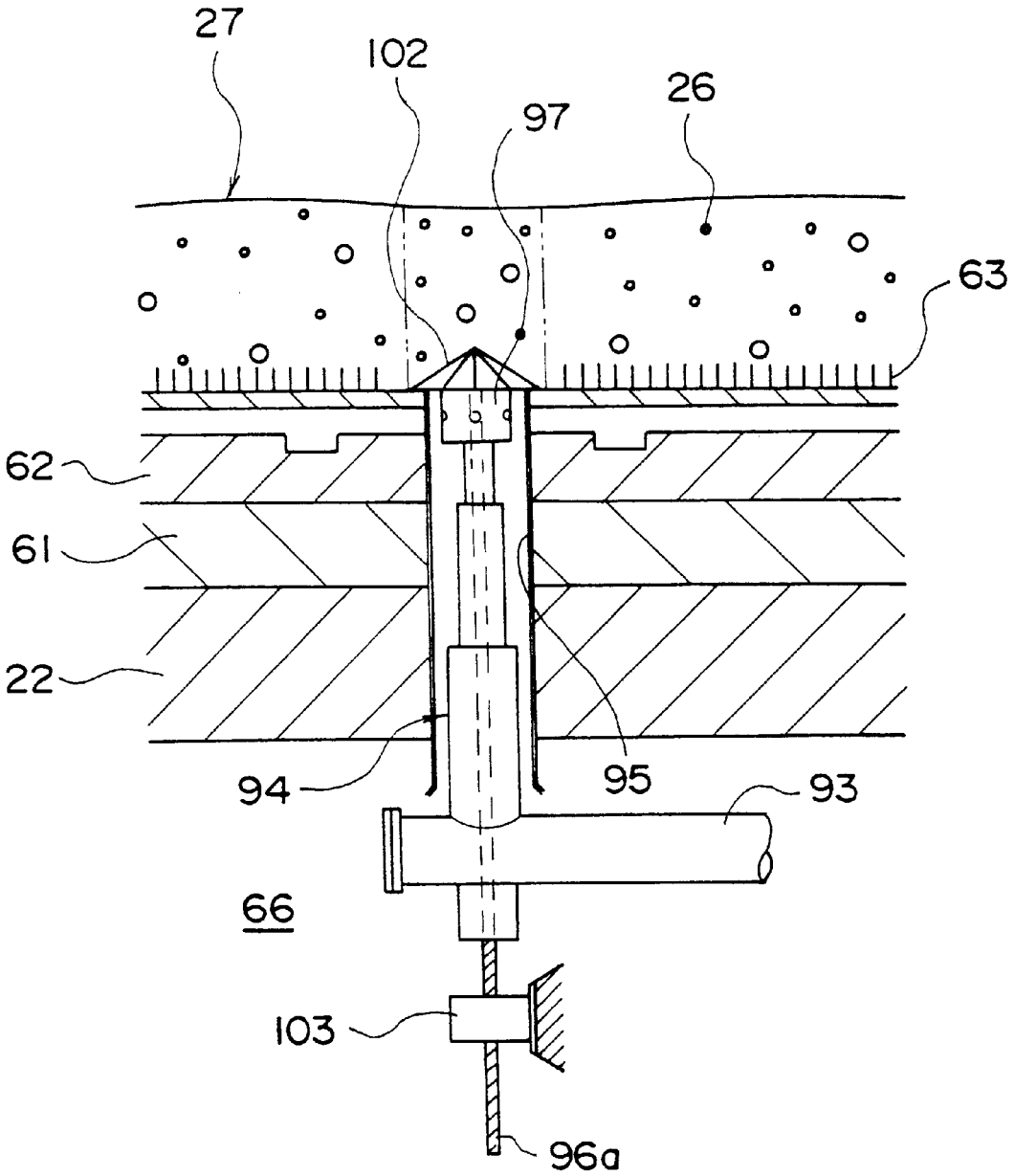
FIG. 18 is a partial sectional view showing a modified example of an expansion pipe equipped with a cold air blowoff nozzle in the indoor type skiing ground.
Figure 19:
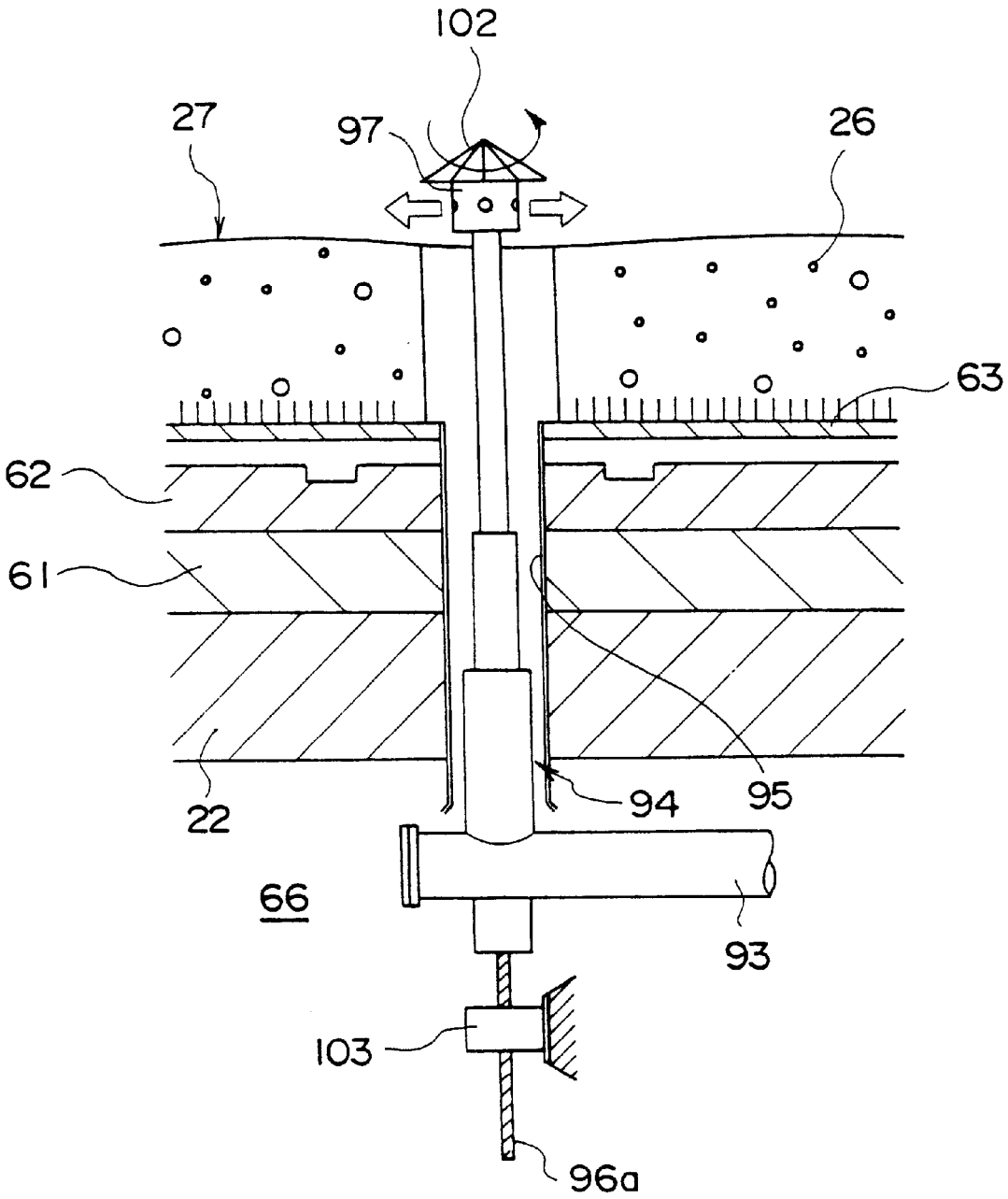
FIG. 19 is a sectional view showing the operating state of the expansion pipe equipped with the cold air blowoff nozzle.

In the foregoing embodiment, the cover 98 larger than the hole 95 is attached to the top surface of the nozzle 97. However, as shown in FIGS. 18 and 19, an accumulated snow drilling unit may be mounted on the top end of a telescopic expansion pipe 94. That is, at the top end of the expansion pipe 94, a conical cutter 102 with a plurality of blades is rotatably mounted on the upper surface of the nozzle 97 via a bearing, and a slit portion is formed between the adjacent blades for dropping scraped snow therethrough. An operating rod 96*a* for extending or contracting the expansion pipe 94 extends into the expansion pipe 94 from below the branch pipe 93 via a seal. The operating rod 96*a* vertically moves the nozzle 97 at its thrust portion, and is rotationally driven by a reversible motor 103 fixed to a machine room 66. Simultaneously, the operating rod 96*a* is vertically moved by a spiral guide portion of the motor 103 in accordance with the direction of rotation.

To change the expansion pipe 94 from an accommodated state illustrated in FIG. 18 to a usable state shown in FIG. 19, the motor 103 is actuated. As a result, the operating rod 96*a* is moved upward by the spiral guide portion to move the nozzle 97 upwards. Also, the cutter 102 is rotated to scrape accumulated snow and bore a hole therein. The cutter 102 has the slit portions, but also serves as a cover for the hole 95. To bring this usable state to the accommodated state, the motor 103 is rotated reversely. As another modified embodiment, an electric heater may be mounted on the nozzle 97 as the accumulated snow drilling unit, and the expansion pipe 94 may be of a bellows type, instead of a telescopic one.

According to the above-mentioned indoor skiing ground of the present invention, the cold air blowoff nozzles are provided at the upper end of the expansion pipes provided expandably in holes formed in the slope. Thus, it is possible to bore a hole at a snow-accumulated site by scooping or the like in a mobilized manner on a required occasion or in a required place in view of the number of skiers or the state of the snow surface, then extend the expansion pipe from inside the hole of the slope to an area near the snow surface, and jet cold air through the nozzle at the upper end of the expansion pipe toward the accumulated snow on the slope, thereby cooling the accumulated snow itself. Consequently, the amount of snow thawed in the ski slope can be reduced, and the quality of snow in the ski slope can be kept satisfactory. Moreover, there is no need to cool the entire air inside the building. Thus, skiers can enjoy skiing in relatively light clothing, and the energy consumption in the building can be kept low.

Furthermore, cold air is also supplied through the plurality of blowoff ports arranged along the slope on at least one side of the slope. Should the blowoff ports below the accumulated snow be clogged, cold air can be fed in a supplemental manner through the blowoff ports arranged along the side of the slope. Besides, the cold air blowoff nozzles each have a cover closing the hole at the top surface thereof. Thus, they can completely prevent snow from entering the hole and ensure the expanding or contracting action of the expansion pipe reliably. In addition, the cold air blowoff nozzles each have at the top end the accumulated snow drilling unit capable of closing the hole. Hence, when cold air is not blown, the cold air blowoff nozzle can be housed in the hole of the slope so as not to allow the entry of snow. When cold air is blown, a hole can be drilled in the accumulated snow automatically, without manual labor, by using the accumulated snow drilling unit such as a turning drill or a heating drill.

<Seventh Embodiment>

An indoor type skiing ground of this embodiment is the same as the indoor type skiing ground of the aforementioned third embodiment in the basic structure. Members having the same functions as described in the third embodiment are assigned the same numerals or symbols, and overlapping explanations will be omitted.

Figure 20:
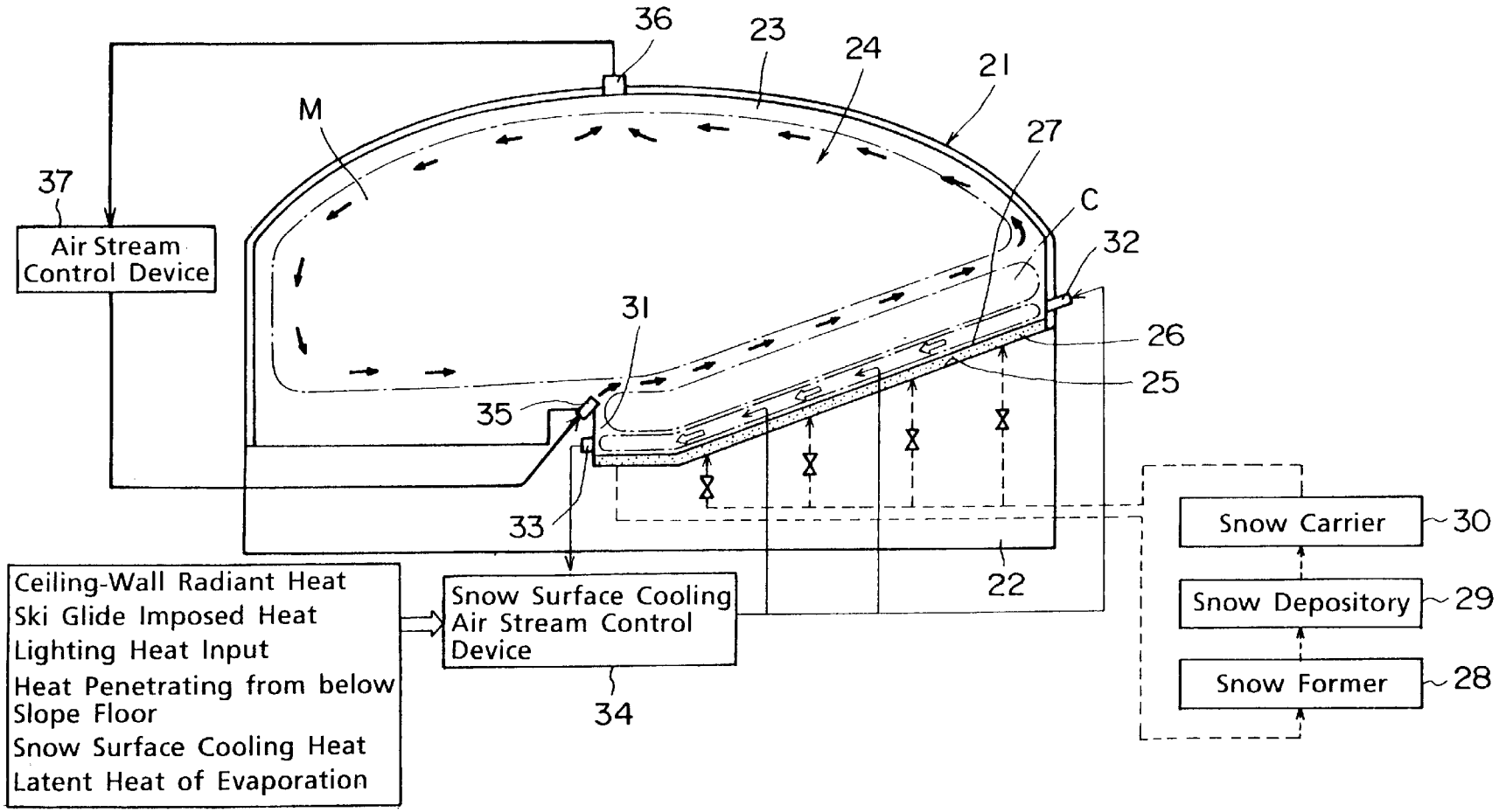
FIG. 20 is a schematic view showing a system of an entire dome to which an indoor type skiing ground related to a seventh embodiment of the present invention has been applied.

In this embodiment, as illustrated in FIG. 20, a dome 21 has a large space 24 defined by a floor surface portion 22 and a ceiling portion 23. The large space 24 is divided into two parts, one of the parts being an ordinary temperature spatial region M, and the other part being a low temperature spatial region C for use as an indoor type skiing ground. On a lower surface of the low temperature spatial region C, a slope 25 is formed. On the slope 25, artificial snow 26 is accumulated to a predetermined thickness to form a ski slope 27. This indoor type skiing ground is equipped with a snow former 28, a snow depository 29, and a snow carrier 30.

On the floor surface portion 22 of the dome 21, an air dam 31 is formed so as to distinguish between the ordinary temperature spatial region M and the low temperature spatial region C by utilizing a difference in height. In a side wall of the dome 21, many cold air ports 32 for blowing off cold air are formed at an upper part and a side part of the ski slope 27. Beside the ski slope 27 and in a side surface portion of the air dam 31 present at a lower part of the ski slope 27, air outlets 33 are formed for discharging air from inside the dome 21. The air outlets 33 are located at a slightly higher position than the cold air ports 32. A snow surface cooling air stream control device 34 supplies cold air, cooled to a temperature enough to maintain the quality of artificial snow 26 at a satisfactory level, through the cold air ports 32 toward the surface of the ski slope 27. This cold air cools the surface of the artificial snow 26, thereby minimizing snow thawing, and keeps the quality of the artificial snow 26 satisfactory.

In the air dam 31, many jet nozzles 35 are provided. The direction of jets through the jet nozzles 35 is toward the ski slope 27, and the blowoff temperature of the jets is 20 to 30° C. The jets through the jet nozzles 35 ascend passing over the cold air flowing on the surface of the ski slope 27, and flow into the ordinary temperature spatial region M along the ceiling portion 23 of the dome 21. In this manner, the jets circulate inside the dome 21.

With the snow surface cooling air stream control device 34 of this embodiment intended to maintain a good quality of snow of the ski slope 27, thawing takes place in a lower surface portion of the artificial snow 26 constituting the ski slope 27, while fresh artificial snow 26 is sprinkled over an upper surface portion of the artificial snow 26 layer for replenishment. Hence, the thickness of the artificial snow 26 of the ski slope 27 is always kept constant. Moreover, the artificial snow 26 of the ski slope 27 is maintained in a good condition by cold air blown off by the snow surface cooling air stream control device 34 onto the upper surface of the ski slope 27. To minimize the amount of snow thawed in the ski slope 27, the temperature of the cold air blown off to the upper surface of the ski slope 27 is adjusted so that heat input to and heat output from the artificial snow 26 of the ski slope 27 are balanced against each other, whereby a heat balance in the ski slope 27 is held at a constant value.

Details of the control by the snow surface cooling air stream control device 34 will be described. Thawing factors for the artificial snow 26 in the ski slope 27 include radiant heat from the ceiling and wall of the dome 21, heat imposed during ski glides on the ski slope 27, heat input from lighting inside the dome 21, heat penetrating the ski slope 27 from below the floor of the slope 25, snow surface cooling heat from cold air supplied to the space above the ski slope 27, and latent heat of evaporation from the ski slope 27. The ceiling/wall radiant heat, the ski glide imposed heat, the lighting heat input, and the heat penetrating from below the slope floor act to warm the artificial snow 26. Whereas the snow surface cooling heat and the latent heat of evaporation act to cool the artificial snow 26. Therefore, these snow thawing factors and their quantity of heat converted to snowmelt have the following relation based on an equation of heat conservation:

Snowmelt converted heat quantity=Ceiling/wall radiant heat+Ski glide imposed heat+Lighting heat input+Heat penetrating from below slope floor−Snow surface cooling heat−Latent heat of evaporation Of these snow thawing factors, the ceiling/wall radiant heat, the ski glide imposed heat, the lighting heat input, and the snow surface cooling heat are variable factors which vary with the number of visitors, the season or the time of the day. Whereas the heat penetrating from below the slope floor and the latent heat of evaporation are constant factors which do not vary. Thus, it is targeted to make the heat input from the snow surface of the ski slope 27 to the artificial snow 26 due to these variable factors (ceiling/wall radiant heat+ski glide imposed heat+lighting heat input−snow surface cooling heat) 7 kcal/m$^2$h or less. To achieve this target, the blowoff temperature $T_0$ of cold air supplied through the cold air ports 32 toward the surface of the ski slope 27 is controlled by the snow surface cooling air stream control device 34 which sets the snow surface cooling heat. By this measure, it is attempted to maintain the temperature $T_c$ of the air stream flowing along the surface of the ski slope 27.

As for the ceiling/wall radiant heat as a variable factor, the range of variations, according to seasonal changes, in the inner surface temperature of the ceiling portion 23 of the dome 21 is assumed to be $\theta$=0.7 to 5.07° C. When these variations are converted to load changes, they are restricted to $\Delta q$=1.10 to 9.216 kcal/m$^2$h. Thus, the inner surface temperature of the ceiling portion 23 and the inner surface temperature of the wall may be actually measured with temperature sensors. Based on these measurements, some temperature-heat quantity change models may be established, whereby the ceiling/wall radiant heat can be pattern-controlled. The ski glide imposed heat is determined from the number of visitors to the ski slope 27 and the intensity of activity as an indicator of heat quantity during a ski glide. The lighting heat input is determined from the power consumption of the lighting.

Figure 21:
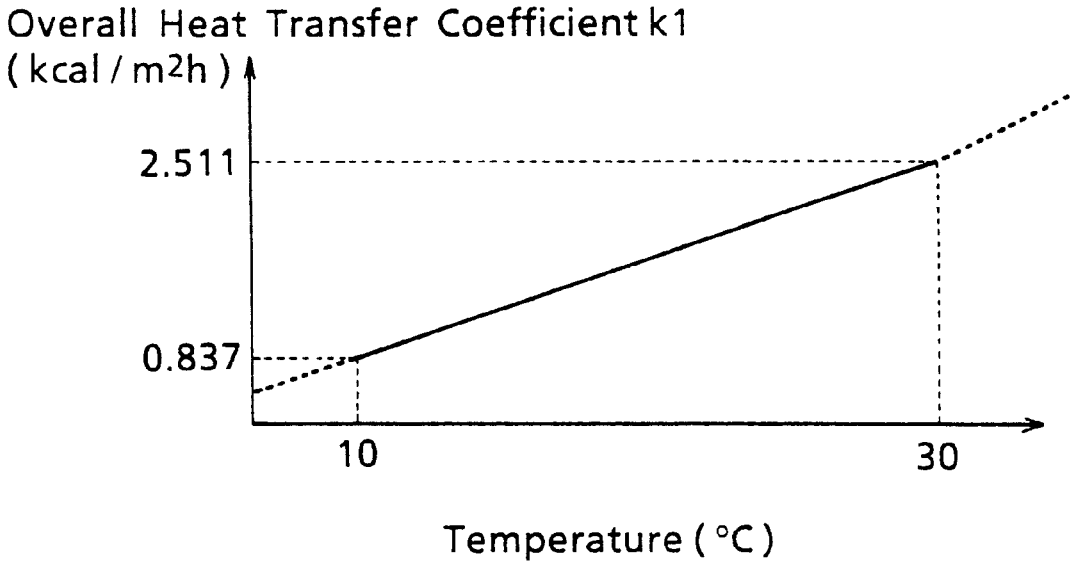
FIG. 21 is a graph showing the overall heat transfer coefficient below the slope floor versus changes in temperature.

The heat penetrating from below the slope floor, which is a constant factor, will be considered. The ski slope 27 is formed from the urethane insulation, concrete floor, artificial lawn, and artificial snow 26 of a predetermined thickness laid in this order on the floor surface portion 22 of the dome 21. Let the lower surface of the artificial lawn be a measuring point A, and the lower surface of the floor surface portion 22 (the ceiling surface of the machine room) be a measuring point B. From the results of measurement of the temperatures at these two measuring points A and B, the overall heat transfer coefficient in the floor portion of the slope 25, k1=0.083 kcal/$m^2$h° C. (at a temperature of 10° C.), is determined. From this overall heat transfer coefficient, the heat penetrating from below the slope floor is determined. At this overall heat transfer coefficient, the range of load changes with seasonal or diurnal changes in temperature is as shown in FIG. 21. Because of high heat insulating performance, the amounts of changes are small. The latent heat of evaporation can be determined as a constant value by performing control for maintaining the snow quality of the ski slope 27, and examining the amount of condensate in the heat exchanger of the snow surface cooling air stream control device 34.

In measuring the snow surface cooling heat, a variable factor, a measuring instrument such as a thermocouple needs to be installed on the ski slope 27. Actually, such an instrument will be an impediment to a ski glide. It maybe conceivable to measure the amount of snow thawed as the snowmelt converted heat quantity, and control the snow surface cooling heat so as to balance the left side and the right side of the aforementioned conversion formula against each other. Even in this case, a measuring apparatus for meltwater must be installed on the ski slope 25, but its installation is difficult. Besides, a delay in measurement of the heat input occurs, so that this measurement is not very reliable.

When the blowoff temperature $T_0$ of cold air through the cold air ports 32 is set to be constant, the air stream temperature $T_c$ on the surface of the ski slope 27 varies with internal changes conferred on the inside of the dome 21. Thus, according to the instant embodiment, the blowoff temperature $T_0$ is controlled to keep the air stream temperature $T_c$ constant. Factors for varying this air stream temperature $T_c$ are generally classified into external variable factors and internal variable factors. The external variable factors include the ceiling/wall radiant heat (f) associated with diurnal changes and the ceiling/wall radiant heat (g) associated with seasonal changes. The internal variable factors include variable factors typified by heat generation from human bodies, i.e., the density (h) of visitors on the ski slope (ski glide imposed heat)

Figure 22:
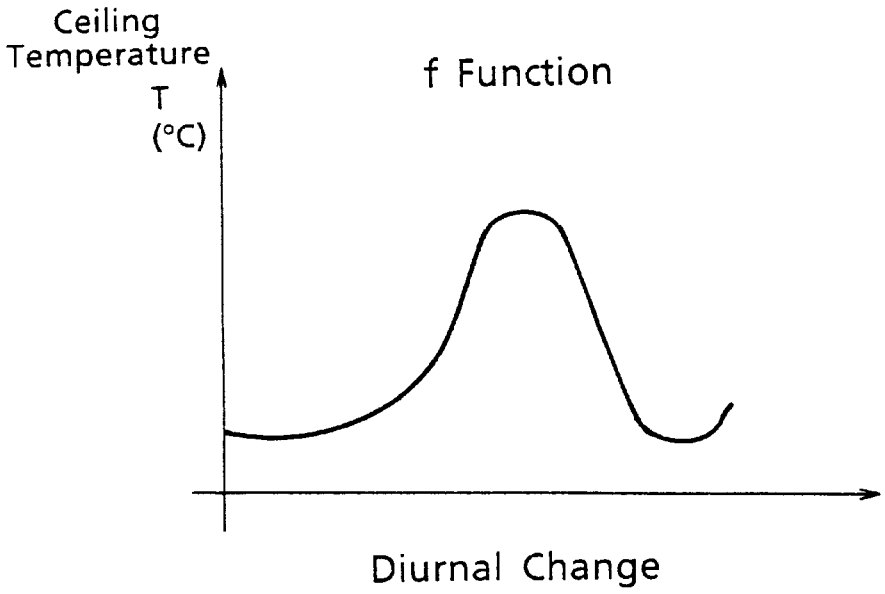
FIG. 22 is a graph showing the ceiling temperature versus diurnal changes.
Figure 23:
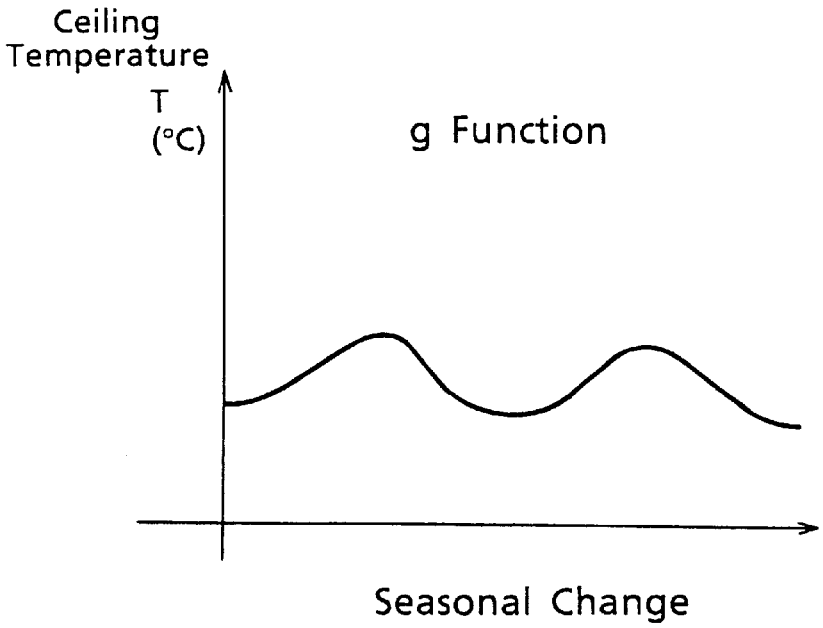
FIG. 23 is a graph showing the ceiling temperature versus seasonal changes.

The ceiling/wall radiant heat (f) associated with diurnal changes and the ceiling/wall radiant heat (g) associated with seasonal changes, as the external variable factors, can be formulated into models as shown in FIGS. 22 and 23, respectively. It would make the measurement and control complicated to measure these external variable factors and reflect the measured values in the air stream temperature $T_c$. Therefore, the variation characteristics of the inner temperature of the ceiling portion 23 according to diurnal changes and seasonal changes are roughly investigated to work out the f function and g function. Values preset based on these functions are used for pattern control, thereby simplifying control for the blowoff temperature $T_0$.

To back up the simplification of control, variations in the external load according to seasonal changes are assumed to be Summer conditions: 531,500 kcal/h Winder conditions: 381,000 kcal/h with the number of visitors accommodated in the dome being set at 686. Based on the analysis of the overall heat transfer coefficient, the overall heat transfer coefficient of the roof material is estimated at k=0.159644 kcal/$m^2$h° C. When the area of the roof is 27,098 $m^2$, the load change Aq occurring when the temperature difference between the atmospheric temperature and the temperature inside the dome increases by 1° C. is Δq=4,323 kcal/h This value is about 1% of the entire load change.

Next, the error in the external variation will be considered. When the temperature difference between the roof and the ceiling changes by ±10° C., the difference in the quantity of heat related to the f function is $$\Delta q=(\Delta\theta=\pm 10^\circ\ \text{C.})=\pm 43{,}230\ \text{kcal/h}$$

When converted into the amount of snow thawed, this value gives $$d'=\pm 43{,}230/14500/80/500\times 24\times 1000=\pm 1.79\ \text{mm/day}$$

Figure 25:
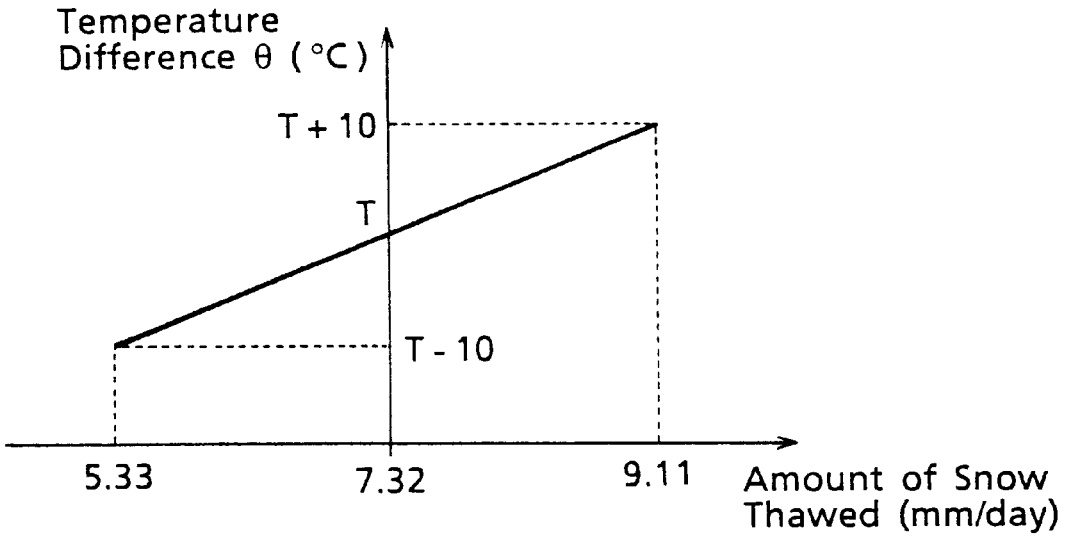
FIG. 25 is a graph showing the amount of snow thawed versus the temperature difference between the roof and ceiling.

The relationship between the roof-ceiling temperature difference and the amount of snow thawed is as shown in FIG. 25. Even if the f function is set in an anticipatory and arbitrary manner, as noted above, an error it will cause would be minor. Thus, the value of the f function is set anticipatorily and arbitrarily (as in feedforward control), while the g function is used, while measuring, daily, the amount of snow thawed, and setting the blowoff temperature $T_0$ of cold air through the cold air ports 22 for the following day on the basis of the amount of thawed snow measured on the preceding day (feedback control).

Further, changes in the quantity of heat with changes in the blowoff temperature $T_0$ of cold air through the cold air ports 22 will be considered in connection with the f function. The quantity of heat required when cold air is blown at −10° C. through the cold air ports 32 throughout the inside of the dome 21, and the required quantity of heat for blowoff at −5° C. will be −10° C. conditions: 840,000 kcal/h −5° C. conditions: 362,000 kcal/h This difference in the required quantity of heat is converted into the amount of snow thawed as follows:

$$D=(840{,}000-362{,}000)/14500/80/500\times 24\times 1000=20\ \text{mm/day}$$

Figure 26:
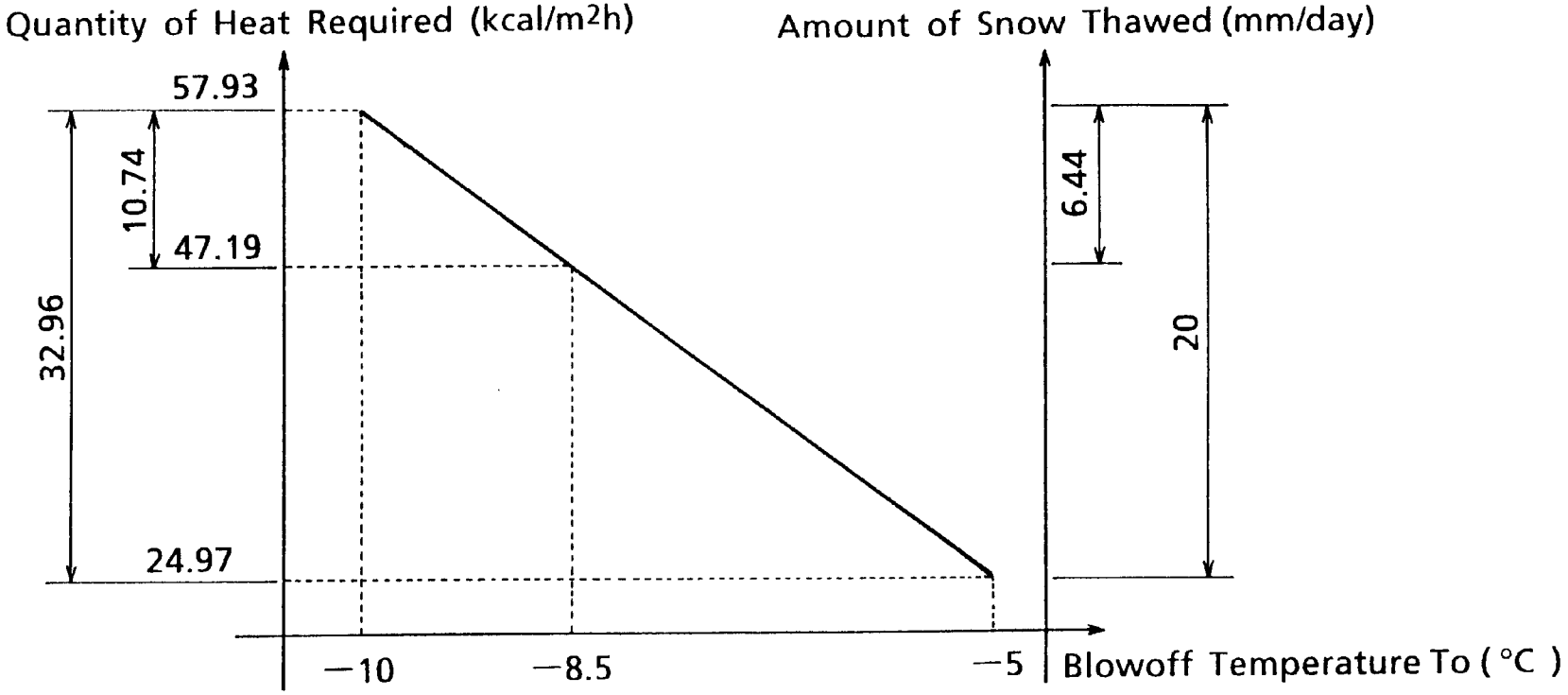
FIG. 26 is a graph showing the quantity of heat required and the amount of snow thawed versus the blowoff temperature of cold air.
Figure 27:
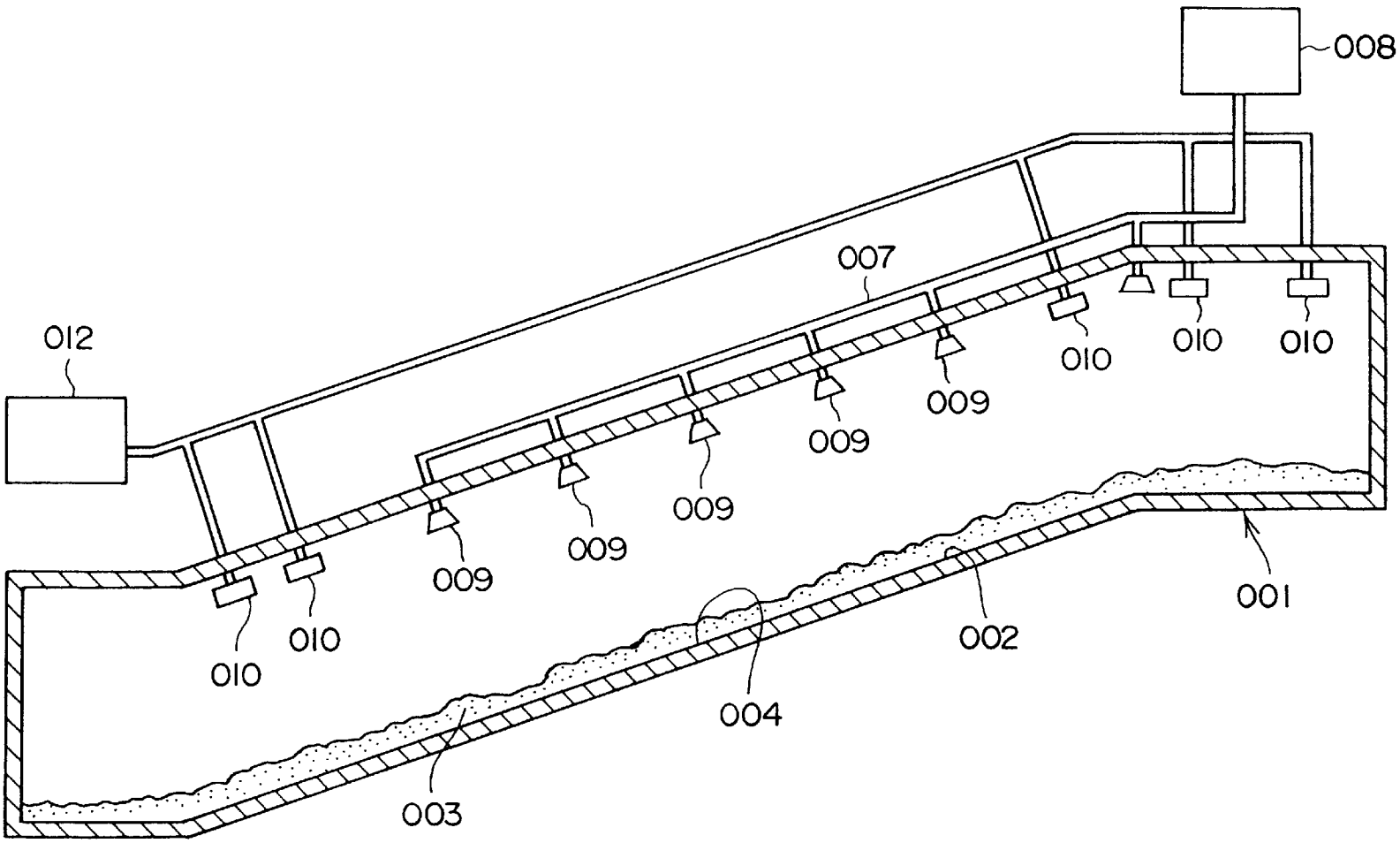
FIG. 27 (PRIOR ART)
FIG. 27 is a schematic side view of the interior of the building of a conventional indoor type skiing ground.
Figure 28:
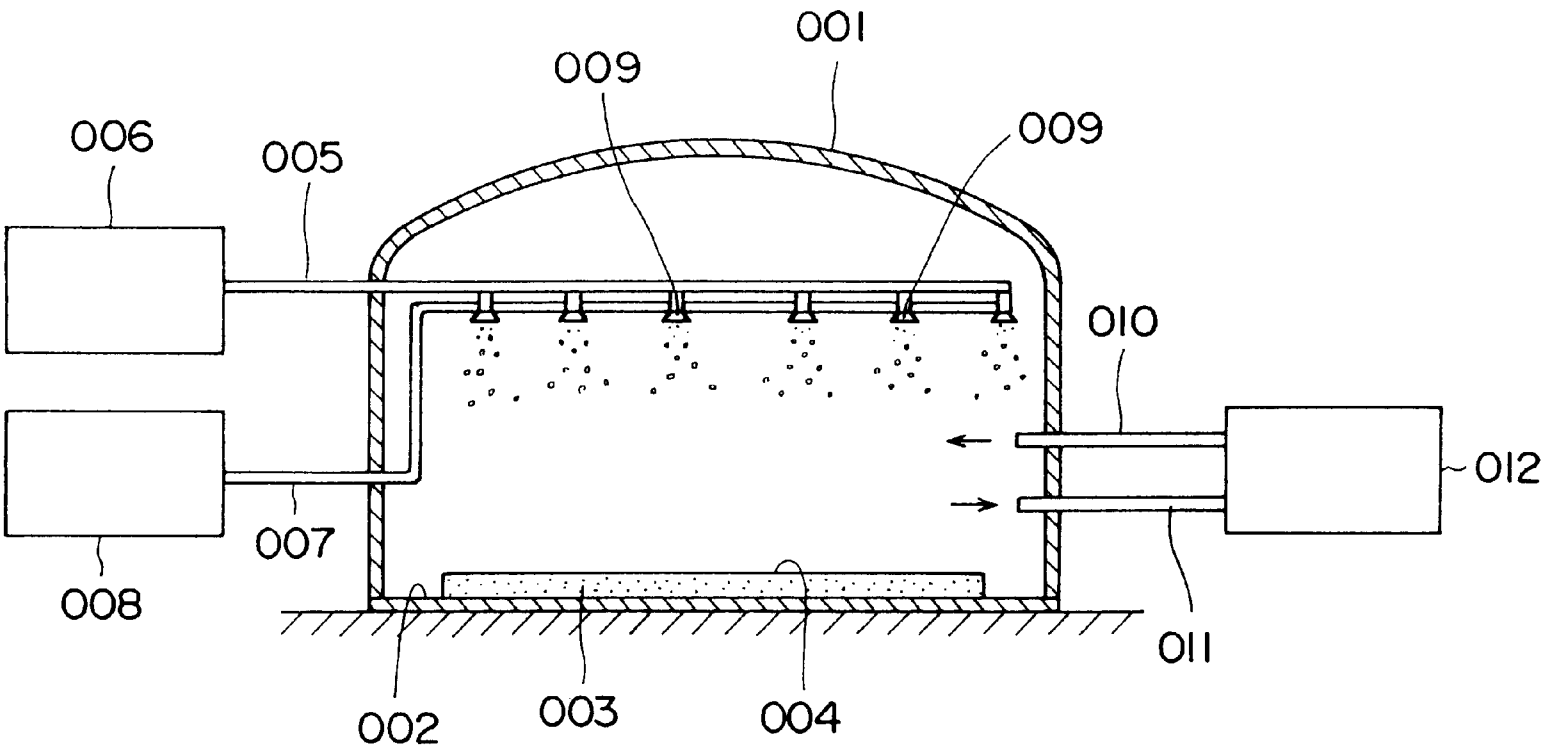
FIG. 28 (PRIOR ART)
FIG. 28 is a schematic front view of the interior of the building of the conventional indoor type skiing ground.

As stated earlier, the change in the quantity of heat according to the change in the number of visitors is about 155,722 kcal/h. Assuming the blowoff temperature under the summer season conditions as $T_0$=−10° C., the change in the blowoff temperature $T_0$ of cold air through the cold air ports 22 due to the change in the number of visitors is 1.5° C. on the average. Thus, the drawing in FIG. 26 holds.

Concerning the ski slope visitors density (ski glide imposed heat) (h), the number of visitors accommodated in the ski slope is estimated, for example, at 686, and the quantity of heat generated by a human body is estimated at, say, 227 kcal/h at an activity intensity of 8. The total quantity of heat, q7, generated by the human bodies of the visitors to the ski slope will be $$q7=227\times686/14500=10.74\ \text{kcal/m}^2\text{h}$$

Figure 24:
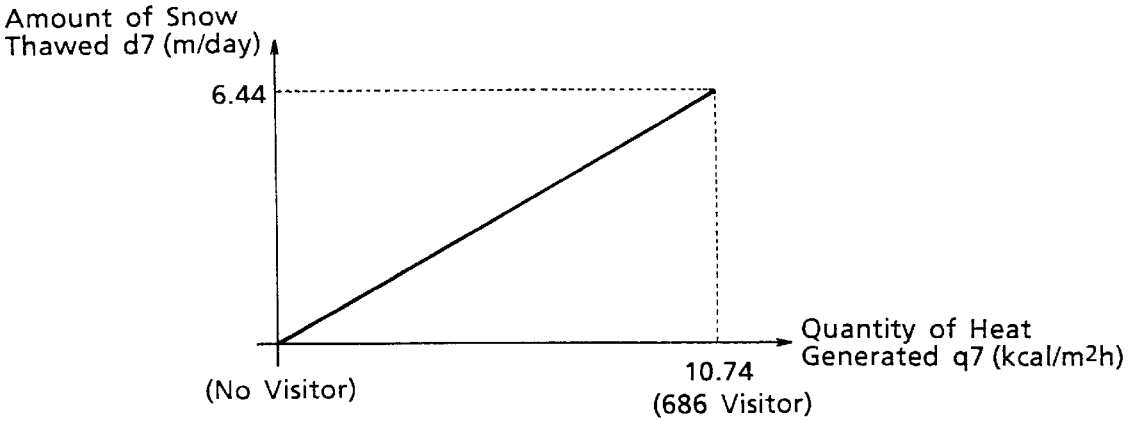
FIG. 24 is a graph showing the amount of snow thawed versus the quantity of heat generated.

Thus, heat changes according to changes in the number of visitors to the ski slope as shown in FIG. 24 are obtained. In this case, the amount of snow thawed, d7, will be $$d7=10.74/80/500\times24\times1000=6.44\ \text{mm/day}$$

Errors in the internal variations will be considered. The interrelationship among the number of visitors, the quantity of heat generated, and the amount of snow thawed is shown in Table 1. The f function is manually inputted and set according to changes in the number of visitors to blow off cold air in a controlled manner according to load changes.

TABLE 1

| Number of visitors | 0 | 50 | 100 | 150 | 200 | 250 | 300 |
|---|---|---|---|---|---|---|---|
| Quantity of heat generated (kcal/m$^2$h) | 0 | 0.78 | 1.57 | 2.35 | 3.13 | 3.91 | 4.70 |
| Amount of snow thawed (mm/day) | 0 | 0.47 | 0.94 | 1.41 | 1.88 | 2.35 | 2.82 |
| Number of visitors | 350 | 400 | 450 | 500 | 550 | 600 | 686 |
| Quantity of heat generated (kcal/m$^2$h) | 5.48 | 6.26 | 7.04 | 7.83 | 8.61 | 9.39 | 10.74 |
| Amount of snow thawed (mm/day) | 3.29 | 3.76 | 4.22 | 4.70 | 5.17 | 5.63 | 6.44 |

The temperature of the ambient environment is also expected to be changed by about 1.5° C., as stated above, according to the internal load change due to the human body. Thus, the temperature change of the ambient environment is also used as a parameter for setting the blowoff temperature $T_0$ of cold air through the cold air ports 22. The function h is determined as this parameter.

Details of the control and items for measurement will be summarized as follows:

1) The temperature of the ceiling portion 23 is measured to estimate the quantity of radiant heat, and the measurements obtained are utilized as correction values for diurnal changes and seasonal changes (determination of the f function and the g function).
2) To measure the heat penetrating from below the slope floor, the difference in temperature between the two measuring points A and B in the floor portion of the slope 25 is measured.
3) The variation curve of the f function is determined artificially beforehand.
4) The amount of snow thawed is measured daily for correction of the g function.
5) The h function is determined in accordance with the number of visitors.
6) The change in the blowoff temperature $T_0$ of cold air through the cold air ports 22 is set at about 1.5° C. as a correction for the h function.

In the so constructed dome 21 of the instant embodiment, as shown in FIG. 20, the snow surface cooling air stream control device 34 supplies cold air of, say, −5 to −10° C., enough to keep the quality of artificial snow 26 satisfactory, toward the surface of the ski slope 27 through the plurality of cold air ports 32. The surface of the artificial snow 26 is cooled with this cold air, and its quality is maintained at a satisfactory level, without thawing of the surface. The cold air supplied toward the surface of the ski slope 27 flows downward along the surface of the ski slope 27, exchanges heat, and rises in temperature. The warmed air is passed through the air outlets 33, and returned to the snow surface cooling air stream control device 34. In this device 34, heat exchange (cooling) is performed, and the cooled air is supplied again to the ski slope 27 through the cold air ports 32.

The air stream control device 37 directs jets of, say, 20 to 30° C., enough to maintain the inside of the dome 21 at an ordinary temperature, toward the ski slope 27 through the plurality of jet nozzles 35. These jets ascend passing over the cold air flowing along the surface of the ski slope 27, and circulates along the ceiling portion 23 of the dome 21, thus dividing the inside of the dome 21 into the ordinary temperature spatial region M and the low temperature spatial region C. Part of the air stream flowing along the ceiling portion 23 of the dome 21 passes through the discharge holes 36, and is returned to the air stream control device 37. In this device 37, the air is heat-exchanged (cooled), and ejected again as jets through the jet nozzles 35 toward the ski slope 27.

In the ski slope 27 of the indoor type skiing ground, the artificial snow 26 melts on the lower surface side, and the resulting meltwater is returned to the snow former 18 through the meltwater channels (not shown) This snow former 18, where necessary, produces artificial snow 26 by the use of tap water and the meltwater, and the resulting artificial snow 26 is stored in the snow depository 29. The snow carrier 30 carries the artificial snow 26 in the snow depository 29 to the ski slope 27 in accordance with the amount of snow thawed, and sprinkles it over the ski slope 27.

The snow surface cooling air stream control device 34 blows cold air toward the upper surface of the artificial snow 26 of the ski slope 27 through the cold air ports 32. The artificial snow 26 is maintained in a satisfactory quality by the cold air without thawing of its surface. The blowoff temperature $T_0$ of cold air blown through the cold air ports 32 toward the ski slope 27 is adjusted by using the ceiling/wall radiant heat, ski glide imposed heat, lighting heat input, heat penetrating from below the slope floor, snow surface cooling heat, and latent heat of evaporation as control factors, as stated previously; and balancing heat input and heat output against each other, namely, setting the snowmelt heat quantity consistent with the amount of snow thawed to keep heat balance constant.

According to the indoor skiing ground of the present invention described above, the ceiling/wall radiant heat, ski glide imposed heat, lighting heat input, heat penetrating from below the slope floor, snow surface cooling heat, and latent heat of evaporation are used as control factors, and the temperature of cold air supplied to the space above the snow accumulated area is adjusted to control the snow surface cooling heat so as to balance it against these types of heat, whereby the heat balance is held at a constant value. Thus, there is no need to scrape off the deteriorated artificial snow on the surface of the ski slope, or carry the scraped snow. Nor is it necessary to forbid ski glides by shutting off the ski slope. The snow quality of the ski slope can always be kept satisfactory with energy consumption being suppressed more accurately. Consequently, it is possible to maintain a satisfactory quality of snow while reducing the amount of snow thawed in the ski slope.

Also, the radiant heat from the ceiling and wall is determined from the temperature-heat quantity change model which is selected according to the temperature of the inner surface of the ceiling and the temperature of inner surface of the wall in the building and which is in a certain relationship therewith, the heat imposed during ski glides is determined from the number of visitors to the ski slope and activity intensity which serves as an indicator of heat generation during a ski glide, the heat input from lighting is determined from the power consumption of the lighting, the heat penetrating from below the floor of the slope is determined as an overall heat transfer coefficient from measurements of the temperatures at the upper and lower surfaces of the snow accumulated portion, and the latent heat of evaporation is determined from the amount of condensate in a returned air stream of cold air supplied to the space above the snow accumulated portion. Thus, there is no need to install a measuring instrument separately on the ski slope, and the quality of snow can be maintained at a high level by the use of the existing apparatus.

What is claimed is:

1. An indoor type skiing ground comprising:

a ski slope formed by sprinkling artificial snow to a predetermined thickness on a slope inside a building, and wherein cold air inlet ports, located adjacent the surface of the artificial snow for blowing cold air into the building, are formed in a side wall of the building and, wherein air outlets located above the cold air ports for discharging cold air lying near the surface of the artificial snow are also formed in the side wall of the building.

2. The indoor type skiing ground as claimed in claim 1, wherein the interior of the building has a low temperature region extending upward to a predetermined height from the surface of the artificial snow, and an ordinary temperature region above the low temperature region, and wherein the cold air inlet ports and the air outlets are located in the low temperature region.

3. The indoor type skiing ground as claimed in claim 1, wherein the cold air ports are each in the form of an elongated slit extending along the surface of the artificial snow.

4. An indoor type skiing ground as claimed in claim 1, and further comprising: a snow former for producing artificial snow, a depository for temporarily storing artificial snow produced by the snow former, a snow carrier for carrying artificial snow stored in the depository, a plurality of snow sprinklers disposed in the ski slope so as to be capable of sprinkling artificial snow carried by the snow carrier onto the entire area of the ski slope surface, a ski slope snow accumulation controller for controlling the snow sprinklers in accordance with the amount of artificial snow accumulated on the ski slope to sprinkle artificial snow in a predetermined area of the ski slope surface, thereby forming an artificial snowfall of a predetermined thickness suitable for ski glides.

5. The indoor type skiing ground as claimed in claim 4, wherein the snow carrier includes snow carrying pipes for carrying the artificial snow stored in the depository to the ski slope by rotary feeders, and a front end portion of each of a plurality of the snow carrying pipes disposed in the ski slope is fitted with a snow sprinkling nozzle as the snow sprinkler.

6. The indoor type skiing ground as claimed in claim 1, wherein a material for and the thickness of a heat insulating member located beneath the artificial snow are set such that a lower surface portion of an artificial snowfall that constitutes the ski slope is thawed to a predetermined thickness by the action of heat transferred via the heat insulating member.

7. The indoor type skiing ground as claimed in claim 6, wherein the ski slope is composed of the heat insulating member laid on the upper surface of a floor surface portion, a concrete floor laid on the upper surface of the heat insulating member, and an artificial lawn laid on the upper surface of the concrete floor.

8. The indoor type skiing ground as claimed in claim 7, wherein a meltwater channel is formed in the upper surface of the concrete floor at least along the direction of inclination of the slope, and a plurality of through-holes through which meltwater formed by thawing of the artificial snowfall flows down into the meltwater channel are formed in the artificial lawn.

9. The indoor type skiing ground as claimed in claim 1, wherein a partition member for partitioning an inside space of the building vertically into two spaces, a space on the side of the ceiling and a space on the side of the ski slope, is disposed inside the building.

10. The indoor type skiing ground as claimed in claim 1, wherein additional cold air ports for blowing cold air to the vicinity of the surface height of the artificial snow are also formed in an upper part of the slope, and wherein air outlets for discharging cold air lying near the surface of the artificial snow are also formed in a lower part of the slope.

11. The indoor type skiing ground as claimed in claim 1, wherein a plurality of blowoff ports open at the upper surface of the slope and at a lower portion of the accumulated snow are provided for jetting cold air at a high velocity through the artificial snow on the slope toward areas above the snow surface.

12. The indoor type skiing ground as claimed in claim 11, wherein the plurality of blowoff ports are located in a central portion of the ski slope.

13. The indoor type skiing ground as claimed in claim 1, wherein an expansible expansion pipe is provided in a hole formed in the slope, and a cold air blowoff nozzle for blowing off cold air to the vicinity of the surface height of the artificial snow is provided at an upper end portion of the expansion pipe.

14. The indoor type skiing ground as claimed in claim 13, wherein the cold air blowoff nozzle has at the top a cover for closing the hole.

15. The indoor type skiing ground as claimed in claim 13, wherein the cold air blowoff nozzle has an accumulated snow drilling unit for forming in the artificial snow a communication hole which communicates with the upper portion of the hole.

16. A method for controlling an indoor type skiing ground, which comprises the steps of: sprinkling artificial snow to a predetermined thickness on a slope inside a building to form a ski slope, supplying cold air to a surface of the artificial snow at a first height at or above said surface, removing cold air supplied to said surface from a second height above said first height and thawing a lower surface portion of an artificial snowfall constituting the ski slope, while sprinkling artificial snow on an upper surface portion of the artificial snowfall, to replenish artificial snow, thereby maintaining the thickness of the artificial snowfall of the ski slope at a constant value.

17. The method for controlling an indoor type skiing ground as claimed in claim 16, wherein radiant heat from a ceiling and wall of the building, heat imposed during ski glides on the ski slope, heat input from lighting inside the building, heat penetrating from below a floor of the slope, snow surface cooling heat from cold air supplied to a space above a snow accumulated portion, and latent heat of evaporation from the snow accumulated portion are used as control factors; and the temperature of the cold air supplied at said first height at or above the snow accumulated portion for controlling the snow surface cooling heat is adjusted so that the snow surface cooling heat and the latent heat of evaporation are balanced against the radiant heat from the ceiling and wall, the heat imposed during ski glides, the heat input from the lighting, and the heat penetrating from below the floor of the slope, whereby a heat balance is held at a constant value.

18. The method for controlling an indoor type skiing ground as claimed in claim 17, wherein the radiant heat from the ceiling and wall is determined from a temperature-heat quantity change model which is selected as a function of the temperature of an inner surface of the ceiling and the temperature of an inner surface of the wall in the building, wherein the heat imposed during ski glides is determined from the number of visitors to the ski slope and activity intensity which serves as an indicator of heat generation during a ski glide, wherein the heat input from the lighting is determined from the power consumption of the lighting, wherein the heat penetrating from below the floor of the slope is determined as an overall heat transfer coefficient from measurements of the temperatures at the upper and lower surfaces of the snow accumulated portion, and wherein the latent heat of evaporation is determined from the amount of condensate in a returned air stream of cold air supplied to the space above the snow accumulated portion.

19. An air stream controller for an indoor type skiing ground having a ski slope formed thereat by sprinkling artificial snow to a predetermined thickness on a slope inside a building, and being adapted to thaw a lower surface portion of a snow accumulated region of the ski slope while sprinkling artificial snow on an upper surface portion of the snow accumulated region so as to replenish artificial snow, and supplying cold air from an air cooler to a space above the snow accumulated region, thereby maintaining the thickness of the snow accumulation region at a constant value, said air stream controller comprising: a snow surface cooling air stream control device which is controlled in response to sensing elements which sense the radiant heat from a ceiling and wall of the building, the heat imposed during ski glides on the ski slope, the heat input from lighting inside the building, the heat penetrating from below a floor of the slope, snow surface cooling heat due to cold air from the air cooler, and the latent heat of evaporation from the snow accumulated region, said control device adjusting the temperature of the cold air blown from the air cooler to control the snow surface cooling heat so that the snow surface cooling heat and the latent heat of evaporation are balanced against the radiant heat from the ceiling and wall, the heat imposed during ski glides, the heat input from the lighting, and the heat penetrating from below the floor of the slope.

* * * * *